US012644636B2

(12) United States Patent
You et al.

(10) Patent No.: US 12,644,636 B2
(45) Date of Patent: Jun. 2, 2026

(54) REFRIGERATOR

(71) Applicant: SAMSUNG ELECTRONICS CO., LTD., Suwon-si (KR)

(72) Inventors: Youngmin You, Suwon-si (KR); Jinyoung Song, Suwon-si (KR); Byungkwan Yang, Suwon-si (KR); Jaehyun Lee, Suwon-si (KR); Jongwoo Han, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 199 days.

(21) Appl. No.: 18/384,560

(22) Filed: Oct. 27, 2023

(65) Prior Publication Data

US 2024/0219098 A1 Jul. 4, 2024

Related U.S. Application Data

(63) Continuation of application No. PCT/KR2023/015980, filed on Oct. 17, 2023.

(30) Foreign Application Priority Data

Jan. 4, 2023 (KR) ..... 10-2023-0001430

(51) Int. Cl.
*F25D 17/06* (2006.01)
*F25D 17/08* (2006.01)

(52) U.S. Cl.
CPC ..... *F25D 17/065* (2013.01); *F25D 17/067* (2013.01); *F25D 17/08* (2013.01); *F25D 2317/067* (2013.01)

(58) Field of Classification Search
CPC .... F25D 2201/10; F25D 23/069; F25D 23/06; F25D 19/00; F25D 11/02
See application file for complete search history.

(56) References Cited

U.S. PATENT DOCUMENTS 9,016,077 B2 4/2015 Cho et al.
10,371,430 B2 8/2019 Kim et al.
(Continued)

FOREIGN PATENT DOCUMENTS

CN 114719518 A 7/2022
JP 10-259986 A 9/1998
(Continued)

OTHER PUBLICATIONS

International Search Report dated Jan. 30, 2024 for International Application No. PCT/KR2023/015980.
(Continued)

*Primary Examiner* — Ana M Vazquez
(74) *Attorney, Agent, or Firm* — STAAS & HALSEY LLP

(57) ABSTRACT

A refrigerator includes an inner case forming a storage compartment, a duct in the storage compartment, the duct including: a duct body, and a first coupling portion on a front side of the duct body, and a partition detachably mountable in front of the duct and dividing the storage compartment into a refrigerating compartment and a freezing compartment, the partition including: a partition body, a second coupling portion on a rear surface of the partition body and couplable to the first coupling portion, a partition hole in the partition body, and a partition insulator within the partition body and including an exposed portion exposed through the partition hole, wherein the partition insulator is configured so that when the partition is mounted in front of the duct and the second coupling portion is coupled to the first coupling portion, the exposed portion is in close contact with the duct body.

19 Claims, 16 Drawing Sheets

(56) References Cited

U.S. PATENT DOCUMENTS

| | | | | |
|---|---|---|---|---|
| 11,326,827 | B2 | 5/2022 | Heo et al. | |
| 2012/0011879 | A1* | 1/2012 | Gu | F25D 17/04 62/408 |
| 2018/0224201 | A1 | 8/2018 | Cha et al. | |
| 2022/0282907 | A1 | 9/2022 | Byeon et al. | |

FOREIGN PATENT DOCUMENTS

| | | | | |
|---|---|---|---|---|
| JP | 11-94432 | | 4/1999 | |
| JP | 2000-180040 | A | 6/2000 | |
| JP | 2001-108359 | | 4/2001 | |
| JP | 2003-21453 | A | 1/2003 | |
| JP | 3507671 | B2 | 3/2004 | |
| JP | 2011-153721 | | 8/2011 | |
| JP | 2020-051654 | | 4/2020 | |
| JP | 2021-173448 | | 11/2021 | |
| KR | 10-0901033 | | 6/2009 | |
| KR | 10-2014-0009647 | | 1/2014 | |
| KR | 10-2018-0039871 | | 4/2018 | |
| KR | 10-1849103 | | 6/2018 | |
| KR | 10-2228898 | | 3/2021 | |
| KR | 10-2380123 | | 3/2022 | |
| KR | 10-2022-0126169 | | 9/2022 | |
| WO | WO-2021213348 | A1 * | 10/2021 | F25D 23/08 |

OTHER PUBLICATIONS

Written Opinion of the International Searching Authority dated Jan. 30, 2024 for International Application No. PCT/KR2023/015980.

Extended European Search Report dated Nov. 10, 2025 for European Application No. 23914912.3.

* cited by examiner

REFRIGERATOR

CROSS-REFERENCE TO RELATED APPLICATIONS

This is a continuation application of International Application PCT/KR2023/015980, filed Oct. 17, 2023, it being further noted that foreign priority benefit is based upon Korean Patent Application No. 10-2023-0001430, filed Jan. 4, 2023, the disclosures of which are incorporated by reference herein in their entireties.

TECHNICAL FIELD

The disclosure relates to a refrigerator with an improved structure.

BACKGROUND ART

In general, a refrigerator, an appliance for keeping food fresh, includes a main body having a storage compartment and a cold air supply for supplying cold air to the storage compartment. The storage compartment includes a refrigerating compartment for refrigerating food and a freezing compartment for freezing food. The storage compartment is typically provided so that a front side thereof is open for storing and removing food, and the open front side of the storage compartment is opened or closed by a door.

Such a refrigerator uses a compressor, condenser, expander, and evaporator to repeat a cooling cycle of compressing, condensing, expanding, and evaporating refrigerant. Both the freezing compartment and the refrigerating compartment may be cooled by a single evaporator provided on the freezing compartment side, or the freezing compartment and the refrigerating compartment may each be provided with an evaporator and cooled independently.

The refrigerator may be classified according to the shape of the storage compartment and the door, and may be classified into a top-mounted freezer (TMF) type refrigerator in which the storage compartment is vertically divided by a horizontal partition wall to form a freezing compartment at the top and a refrigerating compartment at the bottom, and a bottom-mounted freezer (BMF) type refrigerator in which a refrigerating compartment is formed at the top and a freezing compartment is formed at the bottom.

DISCLOSURE

Technical Problem

The present disclosure is directed to providing a refrigerator capable of implementing one storage compartment as a refrigerating compartment and/or a freezing compartment.

Further, the present disclosure is directed to providing a refrigerator capable of preventing conduction of cool air between a refrigerating compartment and a freezing compartment.

Further, the present disclosure is directed to providing a refrigerator capable of preventing cool air from a freezing compartment from leaking into a refrigerating compartment.

Technical tasks to be achieved in this document are not limited to the technical tasks mentioned above, and other technical tasks not mentioned will be clearly understood by those skilled in the art from the description below.

Technical Solution

One aspect of the present disclosure provides a refrigerator including an inner case forming a storage compartment, a duct in the storage compartment, the duct including: a duct body, and a first coupling portion on a front surface of the duct body, wherein the duct allows air to flow through the duct; and a partition detachably mountable in front of the duct so as to divide the storage compartment into a refrigerating compartment and a freezing compartment positioned below the refrigerating compartment, the partition including: a partition body, a second coupling portion on a rear surface of the partition body and couplable to the first coupling portion, a partition hole formed in the partition body, and a partition insulator within the partition body and including an exposed portion exposed through the partition hole, wherein the partition insulator may be configured so that when the partition is mounted in front of the duct and the second coupling portion is coupled to the first coupling portion, the exposed portion may be in close contact with the duct body.

The refrigerator may further include a protrusion protruding from the front surface of the duct body, and wherein when the partition is mounted in front of the duct and the second coupling portion is coupled to the first coupling portion, the protrusion may protrude toward and press against the partition.

One of the first coupling portion and the second coupling portion may include a coupling protrusion, the other one of the first coupling portion and the second coupling portion may include a coupling groove corresponding to the coupling protrusion, and when the partition is mounted in front of the duct and the second coupling portion is coupled to the first coupling portion, the coupling protrusion may be detachably coupled to the coupling groove.

The first coupling portion may include an upper groove, and a lower groove spaced downward from the upper groove, and the second coupling portion may include an upper protrusion, and a lower protrusion spaced downward from the upper protrusion, and when the partition is mounted in front of the duct and the second coupling portion is coupled to the first coupling portion, the upper protrusion may be inserted into the upper groove and the lower protrusion may be inserted into the lower groove.

The first coupling portion may include an upper groove, and a lower groove spaced downward from the upper groove, the protrusion may be disposed between the upper groove and the lower groove, the second coupling portion may include an upper protrusion, and a lower protrusion spaced downward from the upper protrusion, and when the partition is mounted in front of the duct and the second coupling portion is coupled to the first coupling portion, the upper protrusion may be inserted into the upper groove and the lower protrusion may be inserted into the lower groove.

The partition body may include a first partition body having a lower portion, and a second partition body detachably coupled to the lower portion, and a parting line between the first partition body with the second partition body.

The parting line may be closer to the freezing compartment than the refrigerating compartment when the partition is mounted in front of the duct and the second coupling portion is coupled to the first coupling portion.

The refrigerator may further include a duct insulator within the duct body. In response to the protrusion pressing against the partition when the partition is mounted in front of the duct and the second coupling portion is coupled to the first coupling portion, the duct body and the duct insulator may be brought into close contact with each other.

The protrusion may be disposed at a vertical center line of the duct body.

The partition hole may be a first partition hole, the exposed portion may be a first exposed portion, the first partition hole may be formed on the rear surface of the partition body. The partition may further include a second partition hole on a side surface of the partition body, and a second exposed portion exposed through the second partition hole and configured so that when the partition is mounted in front of the duct and the second coupling portion is coupled to the first coupling portion, the second exposed portion may be in close contact with the inner case.

The refrigerator may further include an evaporator disposed within the storage compartment. The duct may further include a first outlet communicating with the refrigerating compartment to allow air that has exchanged heat with the evaporator to be supplied to the refrigerating compartment: a first recovery port positioned below the first outlet and communicating with the refrigerating compartment to allow air in the refrigerating compartment to be recovered, a second outlet communicating with the freezing compartment to allow air that has exchanged heat with the evaporator to be supplied to the freezing compartment; and a second recovery port positioned below the second outlet and communicating with the freezing compartment to allow air in the freezing compartment to be recovered.

The partition may be disposed between the first recovery port and the second outlet when the partition is mounted in front of the duct and the second coupling portion is coupled to the first coupling portion.

The protrusion may include a plurality of protrusions spaced apart from each other.

The refrigerator may further include a sealing member interposed between the duct and the partition when the partition is mounted in front of the duct and the second coupling portion is coupled to the first coupling portion.

The refrigerator may further include a fastening body extending from the partition body and a screw extended through the fastening body and into the duct to maintain a coupling force between the first coupling portion and the second coupling portion when the partition is mounted in front of the duct and the second coupling portion is coupled to the first coupling portion.

Another aspect of the present disclosure provides a refrigerator including an inner case forming a storage compartment, a duct arranged to recover cool air from or to discharge the cold air into the storage compartment, and a partition detachably mounted in front of the duct and configured to divide the storage compartment into a refrigerating compartment and a freezing compartment positioned below the refrigerating compartment. The duct includes a duct body, and a duct insulator disposed within the duct body, and a protrusion configured to press against the partition by protruding forward from the duct body so as to prevent a gap between the duct body and the duct insulator from being generated.

The partition may include a first coupling portion protruding toward the duct, and a second coupling protrusion spaced downward from the first coupling protrusion and protruding toward the duct. The duct may include a first coupling groove provided to accommodate the first coupling protrusion, and a second coupling groove provided to accommodate the second coupling protrusion.

The protrusion may be disposed between the first coupling groove and the second coupling groove.

The partition may include a partition body, a partition hole formed by cutting a portion of the partition body, and a partition insulator disposed within the partition body. A portion of the partition insulator may be exposed to the outside of the partition body through the partition hole.

The partition body may include a first injection molding, and a second injection molding detachably coupled to a lower portion of the first injection molding. A parting line formed by combining the first injection molding and the second injection molding may be provided to be positioned at ½ of a height of the partition body or below ½ of the height of the partition body.

Advantageous Effects

According to the spirit of the present disclosure, a refrigerator may have improved ease of use.

According to the spirit of the present disclosure, a refrigerator may implement one storage compartment as a refrigerating compartment, a freezing compartment, or a divided refrigerating and freezing compartment.

According to the spirit of the present disclosure, a refrigerator may prevent leakage of cool air between a refrigerating compartment and a freezing compartment.

Advantages according to the spirit of the disclosure are not limited to those mentioned above, and other advantages not mentioned will be clearly understood by those skilled in the art from the description below.

MODES OF THE INVENTION

Figure 1:
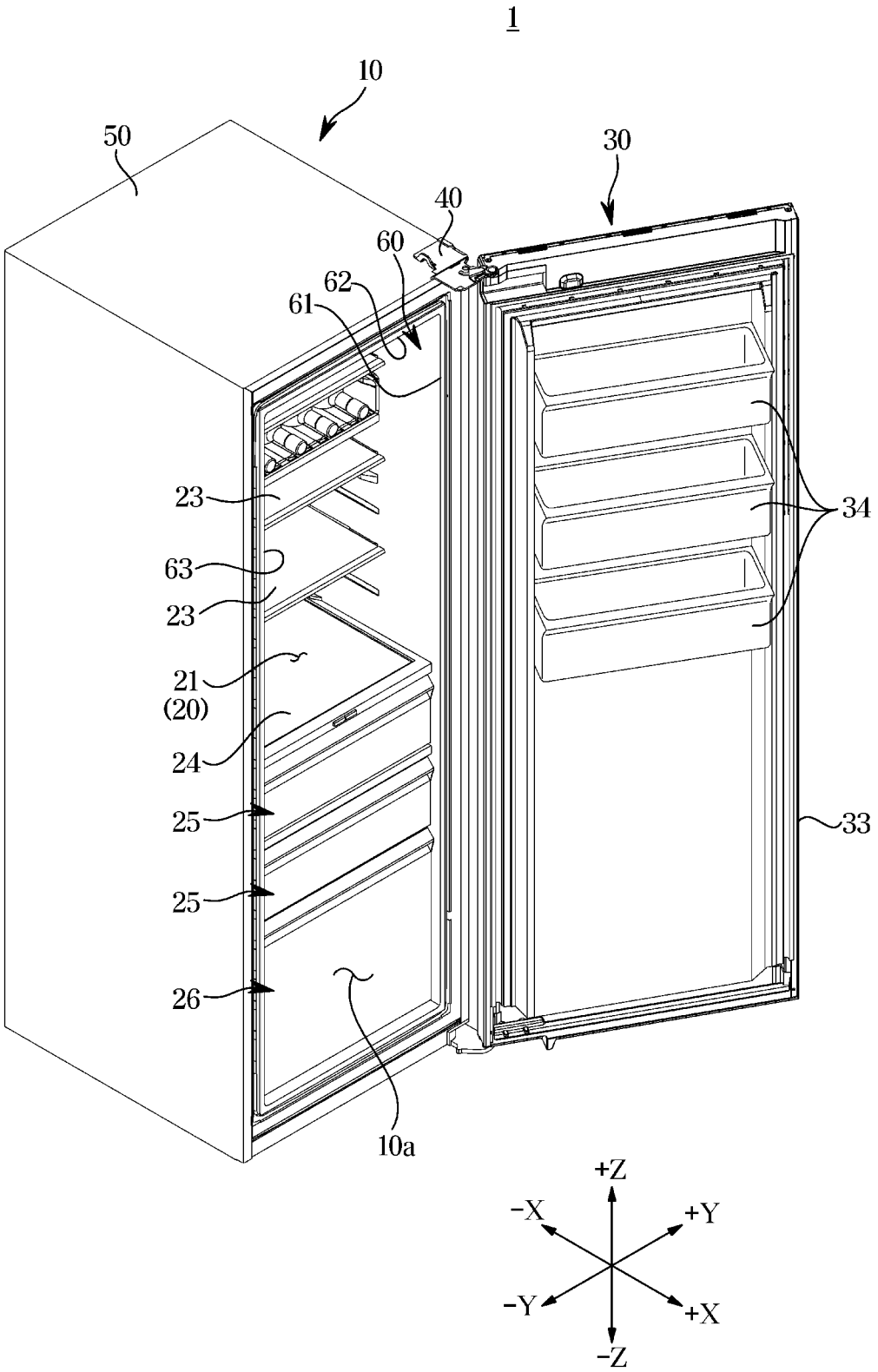
FIG. 1 is a perspective view illustrating an example of a refrigerator according to an embodiment of the disclosure.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this document, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "1st", "2nd", "first" or "second" may be used simply to distinguish a component from other components, without limiting the component in other aspects (e.g., importance or order).

When a component (e.g., a first component) is referred to as "coupled" or "connected" to another component (e.g., a second component), with or without the terms "functionally" or "communicatively," it may refer to that the component may be connected to another component directly (e.g., wired), wirelessly, or through a third component.

Further, as used in the disclosure, the terms "front", "rear", "top", "bottom", "side", "left", "right", "upper", "lower", and the like are defined with reference to the drawings, and are not intended to limit the shape and position of each component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the disclosure may include a main body.

The "main body" may include an inner case, an outer case positioned outside the inner case, and an insulation provided between the inner case and the outer case.

The "inner case" may include a case, a plate, a panel, or a liner forming a storage compartment. The inner case may be formed as one body, or may be formed by assembling a plurality of plates together. The "outer case" may form an appearance of the main body, and be coupled to an outer side of the inner case such that the insulation is positioned between the inner case and the outer case.

The "insulation" may insulate inside of the storage compartment from outside of the storage compartment to maintain inside temperature of the storage compartment at appropriate temperature without being influenced by an external environment of the storage compartment. According to an embodiment of the disclosure, the insulation may include a foaming insulation. The foaming insulation may be molded by fixing the inner case and the outer case with jigs, etc. and then injecting and foaming urethane foam as a mixture of polyurethane and a foaming agent between the inner case and the outer case.

According to an embodiment of the disclosure, the insulation may include a vacuum insulation in addition to a foaming insulation, or may be configured only with a vacuum insulation instead of a forming insulation. The vacuum insulation may include a core material and a cladding material accommodating the core material and sealing the inside with vacuum or pressure close to vacuum. The vacuum insulation may further include an adsorbent for adsorbing a gas and water to stably maintain a vacuum state. However, the insulation is not limited to the above-mentioned foaming insulation or vacuum insulation, and may include various materials capable of being used for insulation.

The "storage compartment" may include a space defined by the inner case. The storage compartment may further include the inner case defining the space. Various items such as food, medicine, and cosmetics may be stored in the storage compartment, one side of the storage compartment may open to enable a user to put in or take out items.

The refrigerator may include one or more storage compartments. In a case in which two or more storage compartments are formed in the refrigerator, the respective storage compartments may have different purposes of use, and may be maintained at different temperature. The storage compartment may be maintained within an appropriate temperature range according to a purpose of use, and include a "refrigerating room", a "freezing room", and a "temperature conversion room" according to purposes of use and/or temperature ranges. The refrigerating room may be maintained at appropriate temperature to keep food refrigerating, and the freezing room may be maintained at appropriate temperature to keep food frozen. The "refrigerating" may be keeping food cold without freezing the food. The "freezing" may be freezing food or keeping food frozen. The temperature conversion room may be used as any one of a refrigerating room or a freezing room according to or regardless of a user's selection. The storage compartment may also be called various other terms, such as "vegetable room", "freshness room", "cooling room", and "ice-making room", in addition to "refrigerating room", "freezing room", and "temperature conversion room", and the terms, such as "refrigerating room", "freezing room", "temperature conversion room", etc., as used below need to be understood to represent storage compartments having the corresponding purposes of use and the corresponding temperature ranges.

The refrigerator according to an embodiment of the disclosure may include at least one door configured to open or close the open side of the storage compartment. The respective doors may be provided to open and close one or more storage compartments, or a single door may be provided to open and close a plurality of storage compartments. The door may be rotatably or slidably mounted on the front of the main body.

The "door" may seal the storage compartment in a closed state. The door may include an insulation, like the main body, to insulate the storage compartment in the closed state.

According to an embodiment, the door may include an outer door plate forming the front surface of the door, an inner door plate forming the rear surface of the door and facing the storage compartment, an upper cap, a lower cap, and a door insulation provided therein.

A gasket may be provided on the edge of the inner door plate to seal the storage compartment by coming into close contact with the front surface of the main body when the door is closed. The inner door plate may include a dyke that protrudes rearward to allow a door basket for storing items to be fitted.

According to an embodiment, the door may include a door body and a front panel that is detachably coupled to the front of the door body and forms the front surface of the door. The door body may include an outer door plate that forms the front surface of the door body, an inner door plate that forms the rear surface of the door body and faces the storage compartment, an upper cap, a lower cap, and a door insulator provided therein.

The refrigerator may be classified as French Door Type, Side-by-side Type, Bottom Mounted Freezer (BMF), Top Mounted Freezer (TMF), or One Door Refrigerator depending on the arrangement of the doors and the storage compartments.

The refrigerator according to an embodiment of the disclosure may include a cool air supply device for supplying cool air to the storage compartment.

The "cool air supply device" may include a machine, an apparatus, an electronic device, and/or a combination system thereof, capable of generating cool air and guiding the cool air to cool the storage compartment.

According to an embodiment of the disclosure, the cool air supply device may generate cool air through a cooling cycle including compression, condensation, expansion, and evaporation processes of refrigerants. To this end, the cool air supply device may include a cooling cycle device having a compressor, a condenser, an expander, and an evaporator to drive the cooling cycle. According to an embodiment of the disclosure, the cool air supply device may include a semiconductor such as a thermoelectric element. The thermoelectric element may cool the storage compartment by heating and cooling actions through the Peltier effect.

The refrigerator according to an embodiment of the disclosure may include a machine room where at least some components belonging to the cool air supply device are installed.

The "machine room" may be partitioned and insulated from the storage compartment to prevent heat generated from the components installed in the machine room from being transferred to the storage compartment. To dissipate heat from the components installed inside the machine room, the machine room may communicate with outside of the main body.

The refrigerator according to an embodiment of the disclosure may include a dispenser provided on the door to provide water and/or ice. The dispenser may be provided on the door to allow access by the user without opening the door.

The refrigerator according to an embodiment of the disclosure may include an ice-making device that produces ice. The ice-making device may include an ice-making tray that stores water, an ice-moving device that separates ice from the ice-making tray, and an ice-bucket that stores ice generated in the ice-making tray.

The refrigerator according to an embodiment of the disclosure may include a controller for controlling the refrigerator.

The "controller" may include a memory for storing and/or memorizing data and/or programs for controlling the refrigerator, and a processor for outputting control signals for controlling the cool air supply device, etc. according to the programs and/or data memorized in the memory.

The memory may store or record various information, data, commands, programs, and the like necessary for operations of the refrigerator. The memory may store temporary data generated while generating control signals for controlling components included in the refrigerator. The memory may include at least one of volatile memory or non-volatile memory, or a combination thereof.

The processor may control the overall operation of the refrigerator. The processor may control the components of the refrigerator by executing programs stored in memory. The processor may include a separate neural processing unit (NPU) that performs an operation of an artificial intelligence (AI) model. In addition, the processor may include a central processing unit (CPU), a graphics processor (GPU), and the like. The processor may generate a control signal to control the operation of the cool air supply device. For example, the processor may receive temperature information of the storage compartment from a temperature sensor, and generate a cooling control signal for controlling an operation of the cool air supply device based on the temperature information of the storage compartment.

Furthermore, the processor may process a user input of a user interface and control an operation of the user interface according to the programs and/or data memorized/stored in the memory. The user interface may be provided using an input interface and an output interface. The processor may receive the user input from the user interface. In addition, the processor may transmit a display control signal and image data for displaying an image on the user interface to the user interface in response to the user input.

The processor and memory may be provided integrally or may be provided separately. The processor may include one or more processors. For example, the processor may include a main processor and at least one sub-processor. The memory may include one or more memories.

The refrigerator according to an embodiment of the disclosure may include a processor and a memory for controlling all the components included in the refrigerator, and may include a plurality of processors and a plurality of memories for individually controlling the components of the refrigerator. For example, the refrigerator may include a processor and a memory for controlling the operation of the cool air supply device according to an output of the temperature sensor. In addition, the refrigerator may be separately equipped with a processor and a memory for controlling the operation of the user interface according to the user input.

A communication module may communicate with external devices, such as servers, mobile devices, and other home appliances via a nearby access point (AP). The AP may connect a local area network (LAN) to which a refrigerator or a user device is connected to a wide area network (WAN) to which a server is connected. The refrigerator or the user device may be connected to the server via the WAN.

The input interface may include keys, a touch screen, a microphone, and the like. The input interface may receive the user input and pass the received user input to the processor.

The output interface may include a display, a speaker, and the like. The output interface may output various notifications, messages, information, and the like generated by the processor.

Hereinafter, various embodiments according to the disclosure will be described in detail with reference to the accompanying drawings.

Figure 2:
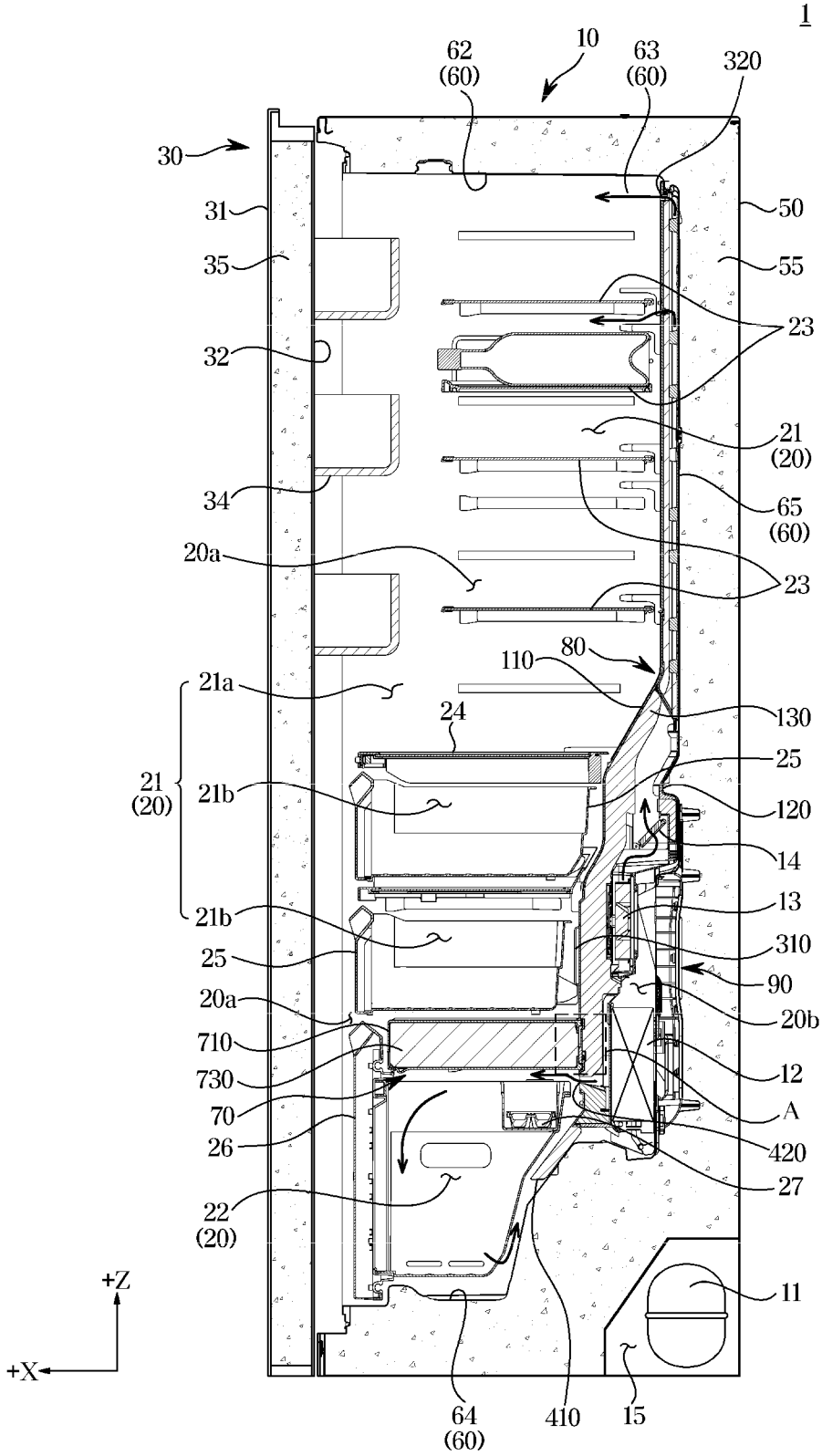
FIG. 2 is a cross-sectional side view illustrating the example of the refrigerator according to an embodiment of the disclosure.

FIG. 1 is a perspective view of an example of a refrigerator according to an embodiment of the disclosure. FIG. 2 is a cross-sectional side view of the example of the refrigerator according to an embodiment of the disclosure.

Referring to FIGS. 1 and 2, a refrigerator 1 may include a main body 10. The refrigerator 1 may include a storage compartment 20 provided within the main body 10. The refrigerator 1 may include a door 30 provided to open or close the storage compartment 20. The refrigerator 1 may include a cooling system provided to supply cool air to the storage compartment 20.

The main body 10 may form at least a portion of the exterior of the refrigerator 1. The main body 10 may have an open front to allow a user to place food in and out of the storage compartment 20. The main body 10 may include an opening 10*a*. The opening 10*a* of the main body 10 may be opened and closed by the door 30.

The door 30 may be provided to open and close the main body 10. The door 30 may be provided to open and close the opening 10*a* of the main body 10. The door 30 may be rotatably coupled to the main body 10. For example, the door 30 may be rotatably coupled to the main body 10 by hinges 40 connected to the door 30 and the main body 10, respectively.

An outer surface 31 of the door 30 may form a portion of the exterior of the refrigerator 1. When the door 30 is closed, the outer surface 31 of the door 30 may form a front surface of the door 30.

An inner surface 32 of the door 30 may be formed on a side opposite to the outer surface 31 of the door 30. When the door 30 is closed, the inner surface 32 of the door 30 may form a rear surface of the door 30. In the closed position of the door 30, the inner surface 32 of the door 30 may be arranged to face the inside of the main body 10. In the closed position of the door 30, the inner surface 32 of the door 30 may be arranged to cover a front side of the storage compartment 20.

The door 30 may include a door insulator 35. The door insulator 35 may be provided between the outer surface 31 of the door 30 and the inner surface 32 of the door 30. For example, a foaming space may be formed between the outer surface 31 of the door 30 and the inner surface 32 of the door 30, and the door insulator 35 may be foamed into the foaming space. The door insulator 35 may prevent heat exchange between the outer surface 31 and the inner surface 32 of the door 30. The door insulator 35 may improve insulation performance between the inside of the storage compartment 20 and the outside of the door 30.

The door insulator 35 may use urethane foam insulation, expanded polystyrene (EPS) insulation, vacuum insulation panels, or the like, but is not limited thereto. The door insulator 35 may include various materials to improve the insulation performance between the storage compartment 20 and the door 30.

For example, the door insulator 35 may be made of the same material as a main body insulator 55, which will be described later. Alternatively, for example, the door insulator 35 may be made of a different material from the main body insulator 55.

The door 30 may include a door gasket 33. The door gasket 33 may be provided on the inner surface 32 of the door 30. The door gasket 33 may seal a gap between the door 30 and the main body 10 to prevent cool air from leaking out of the storage compartment 20. The door gasket 33 may be formed along a circumference of the inner surface 32 of the door 30. The door gasket 33 may be disposed parallel to the opening 10*a* of the main body 10 when the door 30 is closed. The door gasket 33 may be configured to include an elastic material, such as rubber, but is not limited thereto. The door gasket 33 may include various materials to seal the gap between the door 30 and the main body 10.

The door 30 may include a door basket 34 in which food may be stored. One or more door baskets 34 may be provided on the inner surface 32 of the door 30.

For example, the door 30 may be provided to open and close the entire internal space of the main body 10. In particular, the door 30 may be provided to open and close the storage compartment 20 provided within the main body 10. The door 30 may be provided to open and close a first storage compartment 21 and a second storage compartment 22 together, as will be described later. In other words, the first storage compartment 21 and the second storage compartment 22 may be opened and closed by a single door 30 without the need to provide a door to open and close the first storage compartment 21 and a door to open and close the second storage compartment 22.

However, the disclosure is not limited to the above example, and a plurality of doors 30 may be provided to open and close the first storage compartment 21 and the second storage compartment 22, respectively.

For example, when the opening 10*a* of the main body 10 is closed, the door 30 may close the first storage compartment 21 to be described later. In particular, the door 30 may cover a front side of the first storage compartment 21 when the opening 10*a* of the main body 10 is closed.

For example, when the opening 10*a* of the main body 10 is closed, the door 30 may close the second storage compartment 22 to be described later. In particular, the door 30 may cover a front side of the second storage compartment 22 when the opening 10*a* of the main body 10 is closed.

For example, the door 30 may cover a front side of a first drawer 25 to be described later when the opening 10*a* of the main body 10 is closed. When the first drawer 25 is inserted into a first lower storage compartment 21*b*, the front side of the first drawer 25 may be covered by the door 30. However, the disclosure is not limited thereto, and the door 30 may directly close the first lower storage compartment 21*b*.

For example, the door 30 may cover a front side of a second drawer 26 to be described later when the opening 10*a* of the main body 10 is closed. At a position where the second drawer 26 is inserted into the second storage compartment 22, the front side of the second drawer 26 may be covered by the door 30. However, the disclosure is not limited thereto, and the door 30 may directly close the second storage compartment 22.

For example, the door 30 may cover a front of a first shelf 23 when the opening 10*a* of the main body 10 is closed. The first shelf 23 may be completely disposed within the main body 10, and the first shelf 23 may be covered by the door 30 in a state in which the opening 10*a* of the main body 10 is closed, thereby being invisible from the outside.

For example, the door 30 may cover a front side of a second shelf 24 when the opening 10*a* of the main body 10 is closed. The second shelf 24 may be completely disposed within the main body 10, and the second shelf 24 may be covered by the door 30 in a state in which the opening 10*a* of the main body 10 is closed, thereby being invisible from the outside.

The main body 10 may include an outer case 50. The outer case 50 may form at least a portion of the exterior of the refrigerator 1. The outer case 50 may be provided on an outer side of an inner case 60. The outer case 50 may be formed to have substantially the shape of a box with an open front. For example, the outer case 50 may form the top, bottom, left, right, and rear of the refrigerator 1.

The outer case 50 may be configured to include a metal material. For example, the outer case 50 may be manufactured by machining a steel plate material.

The main body 10 may include the inner case 60. The inner case 60 may be provided on an inner side of the outer case 60. The inner case 60 may form the storage compartment 20. An internal space of the inner case 60 may be defined as the storage compartment 20. The inner case 60 may have an open front shape. The inner case 60 may be formed to have substantially the shape of a box with an open front.

The inner case 60 may include inner walls 61, 62, 63, 64, and 65.

In particular, the inner case 60 may include the right wall 61, the upper wall 62, the left wall 63, the lower wall 64, and the rear wall 65. For example, the right wall 61, the upper wall 62, the left wall 63, the lower wall 64, and the rear wall 65 of the inner case 60 may form the storage compartment 20.

The inner case 60 may be configured to include a plastic material. For example, the inner case 60 may be manufactured by a vacuum forming process. For example, the inner case 60 may be manufactured by an injection molding process.

The main body 10 may include the main body insulator 55. The main body insulator 55 may be provided between the outer case 10 and the inner case 60. The main body insulator 55 may be provided to insulate the outer case 50 and the inner case 60 from each other. The main body insulator 55 may be foamed between the outer case 50 and the inner case 60 to allow the outer case 50 and the inner case 60 to be coupled to each other. The main body insulator 55 may prevent heat exchange between the interior of the storage compartment 20 and the exterior of the main body 10, thereby improving cooling efficiency within the storage compartment 20.

The main body insulator 55 may include a urethane foam insulation, an expanded polystyrene (EPS) insulation, a vacuum insulation panel, or the like. However, the disclosure is not limited thereto, and the main body insulator 55 may be configured to include different materials.

The main body 10 may include the storage compartment 20. The storage compartment 20 may be formed by the inner case 60. The storage compartment 20 may be provided as one space inside the inner case 60. The storage compartment 20 may be provided in a single element. For example, the inner case 60 may have substantially the shape of a box with an open front, and the storage compartment 20 may be formed therein.

The storage compartment 20 may be divided into a plurality of compartments by a partition 70. For example, the storage compartment 20 may include the first storage compartment 21 and the second storage compartment 22 by the partition 70.

The main body 10 may include the first storage compartment 21 and the second storage compartment 22. The first storage compartment 21 may be provided above the second storage compartment 22. The first storage compartment 21 may be disposed on an upper side (+Z direction) of the second storage compartment 22. The second storage compartment 22 may be provided below the first storage compartment 21. The second storage compartment 22 may be disposed below the first storage compartment 21 (−Z direction).

The first storage compartment 21 and the second storage compartment 22 may have different temperatures. However, the disclosure is not limited thereto, and the first storage compartment 21 and the second storage compartment 22 may have the same temperature as needed.

For example, the first storage compartment 21 may include a first upper storage compartment 21*a* and a first lower storage compartment 21*b*. The first upper storage compartment 21*a* may be disposed above the first lower storage compartment 21*b*. The first upper storage compartment 21*a* may be disposed above the first lower storage compartment 21*b* (+Z direction). The first lower storage compartment 21*b* may be disposed below the first upper storage compartment 21*a*. The first lower storage compartment 21*b* may be disposed below the first upper storage compartment 21*a* (−Z direction).

For example, the first upper storage compartment 21*a* may be provided with the first shelf 23 on which food may be placed and a storage container (not shown) in which food may be stored. The first shelf 23 may be provided with at least one or more shelves. The storage container may be provided with at least one or more storage container.

For example, the first lower storage compartment 21*b* may be provided with the first drawer 25. The first drawer 25 may be provided to be introduced into or withdrawn from the first lower storage compartment 21*b* through the opening 10*a* of the main body 10. The first drawer 25 may be provided to be drawn in and out in a forward and backward direction (X direction). For example, the second shelf 24 may be disposed above the first drawer 25 (+Z direction). Food may be placed on the second shelf 24. For example, the first lower storage compartment 21*b* may be defined by the first drawer 25 and the second shelf 24.

Differently from the first upper storage compartment 21*a*, the first lower storage compartment 21*b* may be prevented from coming into contact with outside air when the door 30 is opened relative to the main body 10. Accordingly, the first lower storage compartment 21*b* may be a space for food that needs to be stored for a relatively long time compared to the first upper storage compartment 21*a*.

For example, the second storage compartment 22 may be provided with the second drawer 26. The second drawer 26 may be provided to be introduced into or withdrawn from the second storage compartment 22 through the opening 10*a* of the main body 10. The second drawer 26 may be provided to be drawn in and out in the forward and backward direction (X direction). For example, the partition 70 may be disposed above the second drawer 26 (+Z direction). For example, the second storage compartment 22 may be defined by the second drawer 26 and the partition 70. Here, the size of the second storage compartment 22 may vary depending on a location of the partition 70.

On the other hand, the first storage compartment 21 may be provided as a refrigerating compartment and the second storage compartment 22 may be provided as a freezing compartment. In this case, an ice maker 27 may be disposed within the second storage compartment 22, but is only an example. The first storage compartment 21 may be provided as a freezing compartment and the second storage compartment 22 may be provided as a refrigerating compartment. In this case, the ice maker 27 may be disposed within the first storage compartment 21.

In the following, for ease of description, an example in which the first storage compartment 21 is provided as the refrigerating compartment 21 and the second storage compartment 22 is provided as the freezing compartment 22 will be mainly described.

The refrigerating compartment 21 may be provided to refrigerate food. The refrigerating compartment 21 may be maintained at an appropriate temperature for refrigerated storage. For example, the refrigerating compartment 21 may be implemented in a range of −0.5° C. to 8.0° C., but is only an example. The refrigerating compartment 21 may have different temperature ranges. Users may change the temperature range of the refrigerating compartment 21 as needed.

The freezing compartment 22 may be provided to freeze food. The freezing compartment 22 may be maintained at an appropriate temperature for frozen storage. For example, the freezing compartment 22 may be implemented in a range of −24.5° C. to −13.0° C., but is only an example. The freezing compartment 22 may have different temperature ranges. The users may change the temperature range of the freezing compartment 22 as needed.

The refrigerator 1 may include the partition 70. The partition 70 may be disposed in the storage compartment 20. The partition 70 may divide the storage compartment 20 into a plurality of compartments. For example, the partition 70 may partition the storage compartment 20 into the refrigerating compartment 21 and the freezing compartment 22.

The refrigerator 1 may include a cooling system provided to generate cold air using a cooling cycle and supply the generated cold air to the storage compartment 20. The cooling system may generate cold air by using latent heat of evaporation of the refrigerant in the cooling cycle.

For example, the refrigerator 1 may include a compressor 11. For example, the refrigerator 1 may include a condenser (not shown). For example, the refrigerator 1 may include an expansion valve (not shown). For example, the refrigerator 1 may include an evaporator 12. For example, the refrigerator 1 may include a fan 13. For example, the cooling system may include at least one of the compressor 11, the condenser, the expansion valve, the evaporator 12, and the fan 13. The cooling system may also be referred to as a cold air generating device.

A cooling chamber 20*b* may be provided in the main body 10. The evaporator 12 may be provided in the cooling chamber 20*b*. The cooling chamber 20*b* may also be referred to as the cold air forming space 20*b*.

A machine room 15 may be provided in the main body 10. The compressor 11 and the condenser may be provided in the machine room 15.

Parts of the refrigerator 1 constituting the cooling system may have a relatively significant weight. Accordingly, the cooling chamber 20*b* and the machine room 15 may be arranged in a lower portion of the main body 10. However, the disclosure is not limited thereto, and the cooling chamber 20*b* and the machine room 15 may be arranged in various ways. The parts constituting the cooling system may be arranged in different manners to correspond to the positions of the cooling chamber 20*b* and the machine room 15.

The cooling chamber 20*b* may be maintained at a relatively low temperature state due to cold air generated by the evaporator 12. In contrast, the machine room 15 may be maintained at a relatively high temperature state due to heat generated by the compressor 11 and the condenser. Therefore, the cooling chamber 20*b* and the machine room 15 may be formed in a space separated from each other to be thermally insulated. For example, the main body insulator 55 may be provided between the cooling chamber 20*b* and the machine room 15.

The evaporator 12 provided in the cooling chamber 20*b* may generate cool air by evaporating the refrigerant, and the cool air generated by the evaporator 12 may flow through the fan 13. The cool air flowing by the fan 13 may be supplied to the storage compartment 20. The evaporator 12 may generate the cool air in the cooling chamber 20*b*, and the cool air generated by the evaporator 12 may flow from the cooling chamber 20*b* to the storage compartment 20 by the fan 13.

The refrigerator 1 may be an indirect cooling refrigerator. Hereinafter, for ease of description, the refrigerator 1 according to an embodiment of the disclosure is described on the assumption that it is an indirect cooling refrigerator, but the spirit of the disclosure is not limited thereto and may be applied to a direct cooling refrigerator.

The refrigerator 1 may include a damper 14. The damper 14 may be accommodated within a duct 80. The damper 14 may be provided to open or close a flow path formed within the duct 80. The damper 14 may be provided to adjust the degree of opening of the flow path formed within the duct 80. The damper 14 may be provided to adjust an amount of cool air supplied to the refrigerating compartment 21.

The refrigerator 1 may include the duct 80. The duct 80 may be provided to allow cool air to flow. The duct 80 may form a flow path through which cool air flows. The duct 80 may be provided to guide cool air.

The duct 80 may be provided to recover cool air inside the storage compartment or to discharge cool air into the storage compartment.

The duct 80 may be provided to collect cool air within the storage compartment 20 and direct the collected cool air to the evaporator 12. The duct 80 may form a flow path for collecting cool air within the refrigerating compartment 21 to direct the collected cool air to the evaporator 12. The duct 80 may form a flow path for directing cool air within the freezing compartment 22 to the evaporator 12.

The duct 80 may include a first recovery port 310 provided to recover cool air within the refrigerating compartment 21. The first recovery port 310 may be provided to communicate with the refrigerating compartment 21. For example, the first recovery port 310 may be positioned below a first outlet 320, which will be described later.

The duct 80 may include a second recovery port 410 provided to recover cool air within the freezing compartment 22. The second recovery port 410 may be provided to communicate with the freezing compartment 22. For example, the second recovery port 410 may be positioned below a second outlet 420, which will be described later.

The duct 80 may be provided to guide cool air heat-exchanged with the evaporator 12 to the storage compartment 20. The duct 80 may form a flow path for guiding the cool air generated by the evaporator 12 to the refrigerating compartment 21. The duct 80 may form a flow path for guiding the cool air generated by the evaporator 12 to the freezing compartment 22.

The duct 80 may include the first outlet 320 provided to supply the cool air heat-exchanged with the evaporator 12 to the refrigerating compartment 21. The first outlet 320 may be provided to discharge the cool air generated by the evaporator 12 into the refrigerating compartment 21. The first outlet 320 may be provided to communicate with the refrigerating compartment 21.

For example, the first outlet 320 may be positioned above the first recovery port 310. When considering that relatively low temperature cool air may typically move downward by convection, the first outlet 320 may be provided to communicate with an upper portion of the refrigerating compartment 21. The first recovery port 310 may be located far from the first outlet 320 to not allow the cool air discharged from the first outlet 320 to be recirculated immediately. The first recovery port 310 may be provided to communicate with a lower portion of the refrigerating compartment 21, but is only an example. The first outlet 320 may be positioned below the first recovery port 310.

The duct 80 may include the second outlet 420 provided to supply cool air that has heat-exchanged with the evaporator 12 to the freezing compartment 22. The second outlet 420 may be provided to discharge the cool air generated by the evaporator 12 to the freezing compartment 22. The second outlet 420 may be provided to communicate with the freezing compartment 22. For example, a border 421 of the second outlet 420 may be provided to protrude.

For example, the second outlet 420 may be positioned above the second recovery port 410. When considering that relatively low temperature cool air may move downward by convection, the second outlet 420 may be provided to communicate with an upper portion of the freezing compartment 22. The second recovery port 410 may be located far from the second outlet 420 to not allow the cool air discharged from the second outlet 420 to be recirculated immediately. The second recovery port 410 may be provided to communicate with a lower portion of the freezing compartment 22, but is only an example. The second outlet 420 may be positioned below the second recovery port 410.

For example, the partition 70 may be disposed between the first recovery port 310 and the second outlet 420.

The duct 80 may be provided to partition the storage compartment 20 into a storage space 20*a* and the cooling chamber 20*b*. The storage space 20*a* may be a space in which the refrigerating compartment 21 and the freezing compartment 22 are formed. The cooling chamber 20*b* may be a space in which the evaporator 12 is disposed. The cooling chamber 20*b* may be provided behind at least a portion of the storage space 20*a*.

For example, as the duct 80 is mounted on the rear wall 65 of the inner case 60, the storage compartment 20 may be divided into the storage space 20*a* and the cooling chamber 20*b*. For example, when the duct 80 is mounted forward of the rear wall 65, the storage space 20*a* may be a space formed as a front side of the duct 80 in the storage compartment 20. For example, when the duct 80 is mounted forward of the rear wall 65, the cooling chamber 20*b* may be a space formed as a rear side of the duct 80 in the storage compartment 20. For example, the cooling chamber 20*b* may be formed between the duct 80 and the rear wall 65 of the inner case 60.

The duct 80 may be provided to accommodate the damper 14.

The duct 80 may be provided to accommodate the fan 13.

The refrigerator 1 may include a cool air connector 90. The cool air connector 90 may be provided to transfer the cool air inside the refrigerating compartment 21 to the evaporator 12. The cool air connector 90 may be connectable to the duct 80. One side of the cool air connector 90 may communicate with the duct 80. The other side of the cool air connector 90 may communicate with the cooling chamber 20*b*.

The cool air connector 90 may be located outside the inner case 60. The cool air connector 90 may be disposed between the inner case 60 and the outer case 50. For example, the cool air connector 90 may be configured to be embedded within the main body insulator 55.

For example, the refrigerator 1 may have only one evaporator 12. At this time, it is necessary to return the cool air in the refrigerating compartment 21, which has a relatively higher temperature than that of the freezing compartment 22, to the cooling chamber 20*b* and then heat exchange with the evaporator 12. At this time, the cool air connector 90 may be required to transfer the cool air in the refrigerating compartment 21 to the cooling chamber 20*b*.

Figure 3:
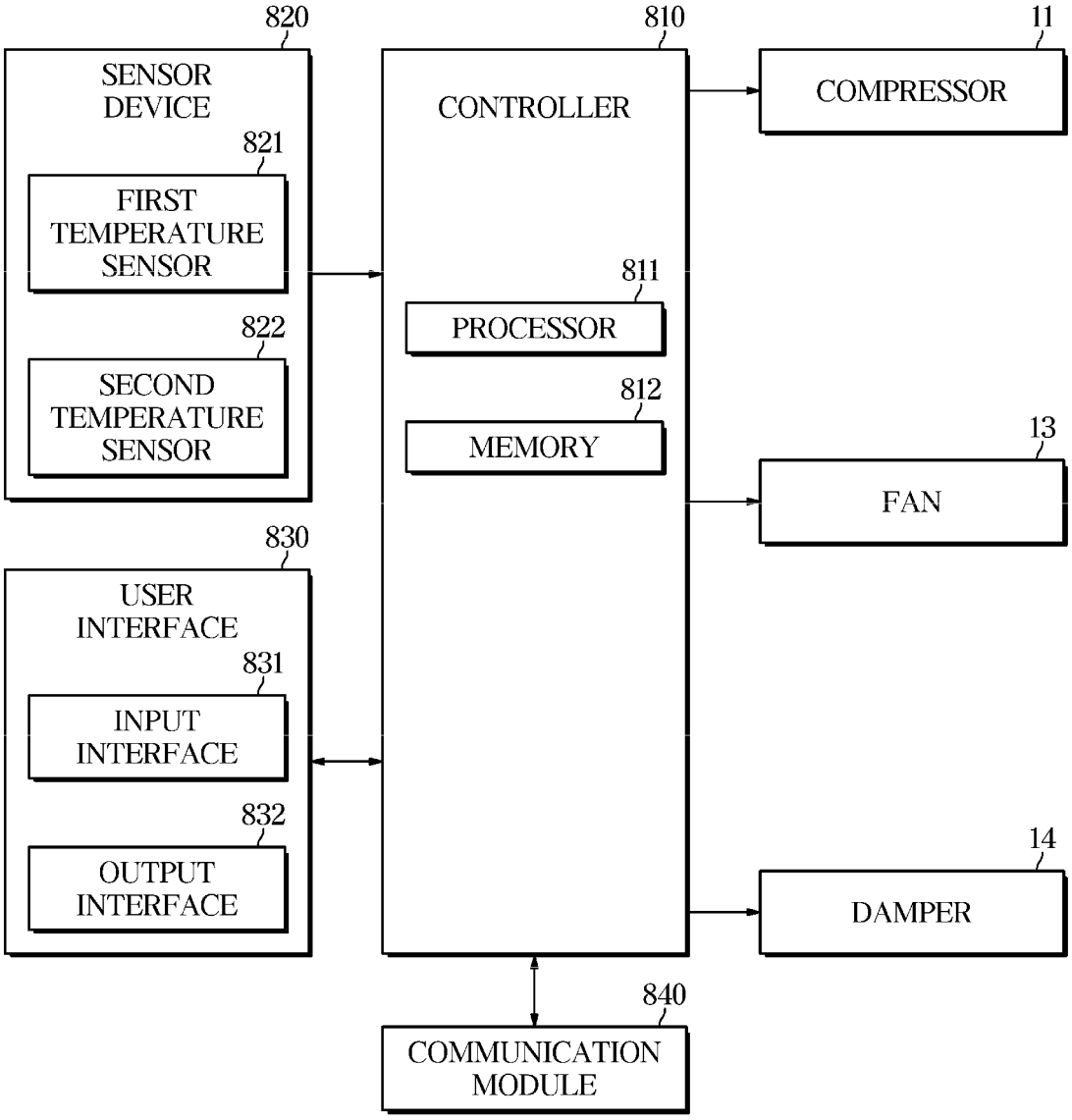
FIG. 3 is a control block diagram illustrating the example of the refrigerator according to an embodiment of the disclosure.

FIG. 3 is a control block diagram illustrating an example of the refrigerator according to an embodiment of the disclosure.

Referring to FIG. 3, the refrigerator 1 may include a controller 810. The refrigerator 1 may include a sensor device 820. The refrigerator 1 may include a user interface 830. The refrigerator 1 may include the compressor 11. The refrigerator 1 may include the fan 13. The refrigerator 1 may include the damper 14. The refrigerator 1 may include a communication module 840.

Each element of the refrigerator 1 shown in FIG. 3 may be omitted depending on an embodiment. An element not shown in FIG. 3 may also be included as an element of the refrigerator 1 according to an embodiment of the disclosure.

The controller 810 may control operations of elements of the refrigerator 1. For example, the controller 810 may control an operation of the compressor 11. For example, the controller 810 may control an operation of the fan 13. For example, the controller 810 may control an operation of the damper 14. For example, the controller 810 may control an operation of the user interface 830. For example, the controller 810 may control an operation of the communication module 840. Furthermore, it should be understood that the controller 810 may control an operation of different elements of the refrigerator 1.

The controller 810 may include at least one memory 812 that stores data in the form of algorithms and/or programs for controlling the operations of the refrigerator 1.

The controller 810 may include at least one processor 811 that generates a control signal associated with the operations of the refrigerator 1. The processor 811 may perform the operations of elements of the refrigerator 1 using data stored in the memory 812.

The memory 812 and the processor 811 may be implemented as separate chips. The processor 811 may include one or more processor chips or may include one or more processing cores. The memory 812 may include one or more memory chips or may include one or more memory blocks. Additionally, the memory 812 and the processor 811 may be implemented as a single chip.

The controller 810 may process a user input received from the user interface 830 and control elements of the refrigerator 1 based on the processing of the user input.

The compressor 11 may be disposed in the machine room 15 provided within the main body 10. The compressor 11 may compress the refrigerant to high temperature and high pressure. The refrigerant compressed by the compressor 11 may be provided to pass through the condenser (not shown). The compressor 11 may operate a cooling cycle of the refrigerator 1.

The fan 13 may be mounted in the duct 80. The fan 13 may be accommodated in the duct 80. The fan 13 may be provided to circulate the cool air generated in the evaporator 12. The fan 13 may circulate cool air in the refrigerator 1.

The damper 14 may be mounted on the duct 80. The damper 14 may be accommodated in the duct 80. The damper 14 may be provided to open and close the flow path formed within the duct 80. For example, when the damper 14 opens the flow path, the cool air generated by the evaporator 12 may be supplied to the refrigerating compartment 21 and the freezing compartment 22. For example, when the damper 14 closes the flow path, the cool air generated by the evaporator 12 may be supplied to the freezing compartment 22. In other words, the damper 14 may adjust the temperature of the refrigerating compartment 21 and the freezing compartment 22 by adjusting the amount of cool air supplied to the refrigerating compartment 21 and/or the freezing compartment 22.

According to various embodiments, the user interface 830 may include an input interface 831 provided to receive the user input and an output interface 832 to display information related to the operations of the refrigerator 1. The user interface 830 may be implemented as a control panel.

For example, the input interface 831 may include at least one of a tact switch, a push switch, a slide switch, a toggle switch, a micro switch, a touch switch, a touch screen, or a button. However, the disclosure is not limited thereto and may include various well-known input devices for receiving a user input.

For example, the output interface 832 may output information related to the refrigerator 1 through a display, voice, or the like. For example, the output interface 832 may include at least one of a liquid crystal display (LCD) panel, a light emitting diode (LED) panel, or a speaker, but is not limited thereto. The output interface may include various well-known output devices for displaying information related to the refrigerator 1.

The sensor device 820 may be configured to detect various states of the refrigerator 1.

The sensor device 820 may include a first temperature sensor 821 for detecting the temperature of the refrigerating compartment 21. The first temperature sensor 821 may be disposed in the refrigerating compartment 21. For example, the first temperature sensor 821 may be detachably mounted on a front surface of the duct 80 exposed to the refrigerating compartment 21 (see FIG. 4). In the case of the partition 70 dividing the storage compartment 20 into the refrigerating compartment 21 and the freezing compartment 22, which is positioned below the refrigerating compartment 21, the first temperature sensor 821 may be positioned above the partition 70.

The controller 810 may control the operation of the damper 14 based on information obtained from the first temperature sensor 821. In response to the first temperature sensor 821 detecting a first predetermined condition, the controller 810 may operate the damper 14 or stop the operation of the damper 14. For example, the controller 810 may control the operation of the damper 14 to open the flow path formed within the duct 80 based on the temperature of the refrigerating compartment 21 being higher than a first predetermined temperature.

The sensor device 820 may include a second temperature sensor 822 provided to detect the temperature of the freezing compartment 22. The second temperature sensor 822 may be disposed in the freezing compartment 22. For example, the second temperature sensor 822 may be detachably mounted on the front surface of the duct 80 exposed to the freezing compartment 22 (see FIG. 4). In the case of the partition 70 dividing the storage compartment 20 into the refrigerating compartment 21 and the freezing compartment 22, which is positioned below the refrigerating compartment 21, the second temperature sensor 822 may be positioned below the partition 70.

The controller 810 may control the operation of the damper 14 based on information obtained from the second temperature sensor 822. In response to the second temperature sensor 822 detecting a second predetermined condition, the controller 810 may operate the damper 14 or stop the operation of the damper 14. For example, the controller 810 may control the operation of the damper 14 to close the flow path formed within the duct 80 based on the temperature of the freezing compartment 22 being higher than a second predetermined temperature.

The communication module 840 may be provided for communication between the refrigerator 1 and one or more external devices. The communication module 840 may transmit information on the refrigerator 1 to an external device. The communication module 840 may receive a user command from the external device. The communication module 840 may include various well-known communication devices.

Figure 4:
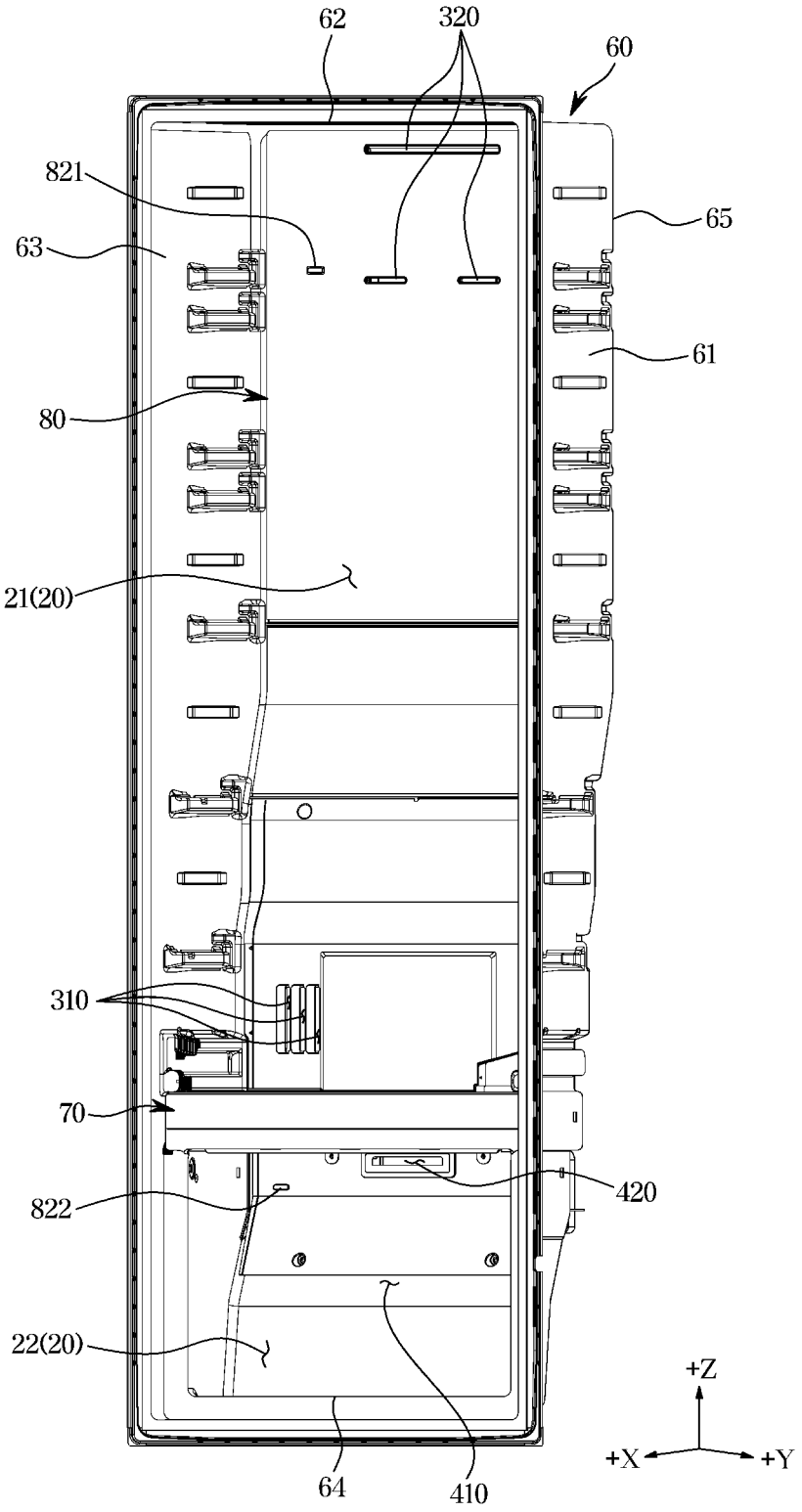
FIG. 4 is a perspective view illustrating some components of the refrigerator according to an embodiment of the disclosure.
Figure 5:
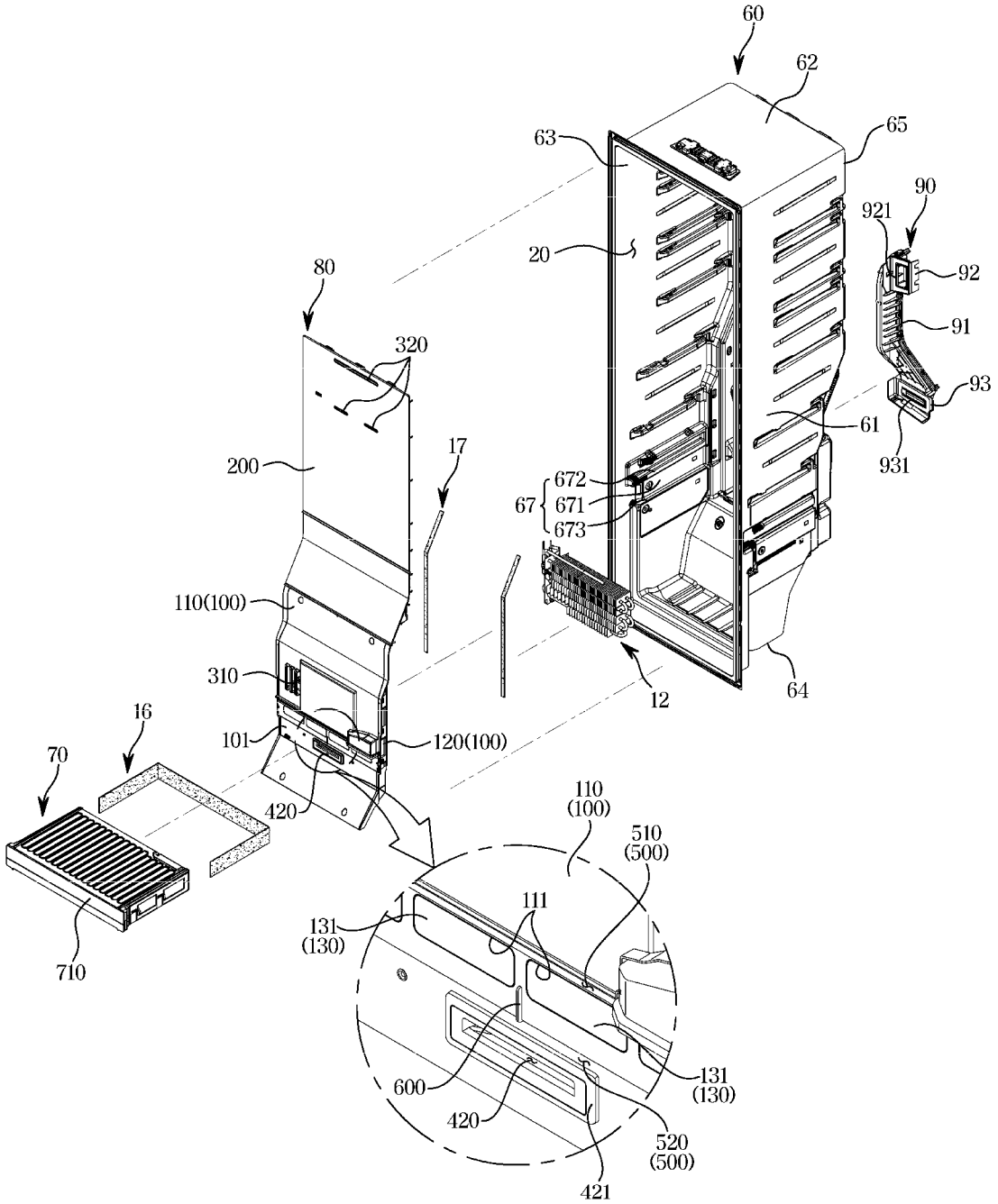
FIG. 5 is an exploded perspective view of some components of the refrigerator shown in FIG. 4.
Figure 6:
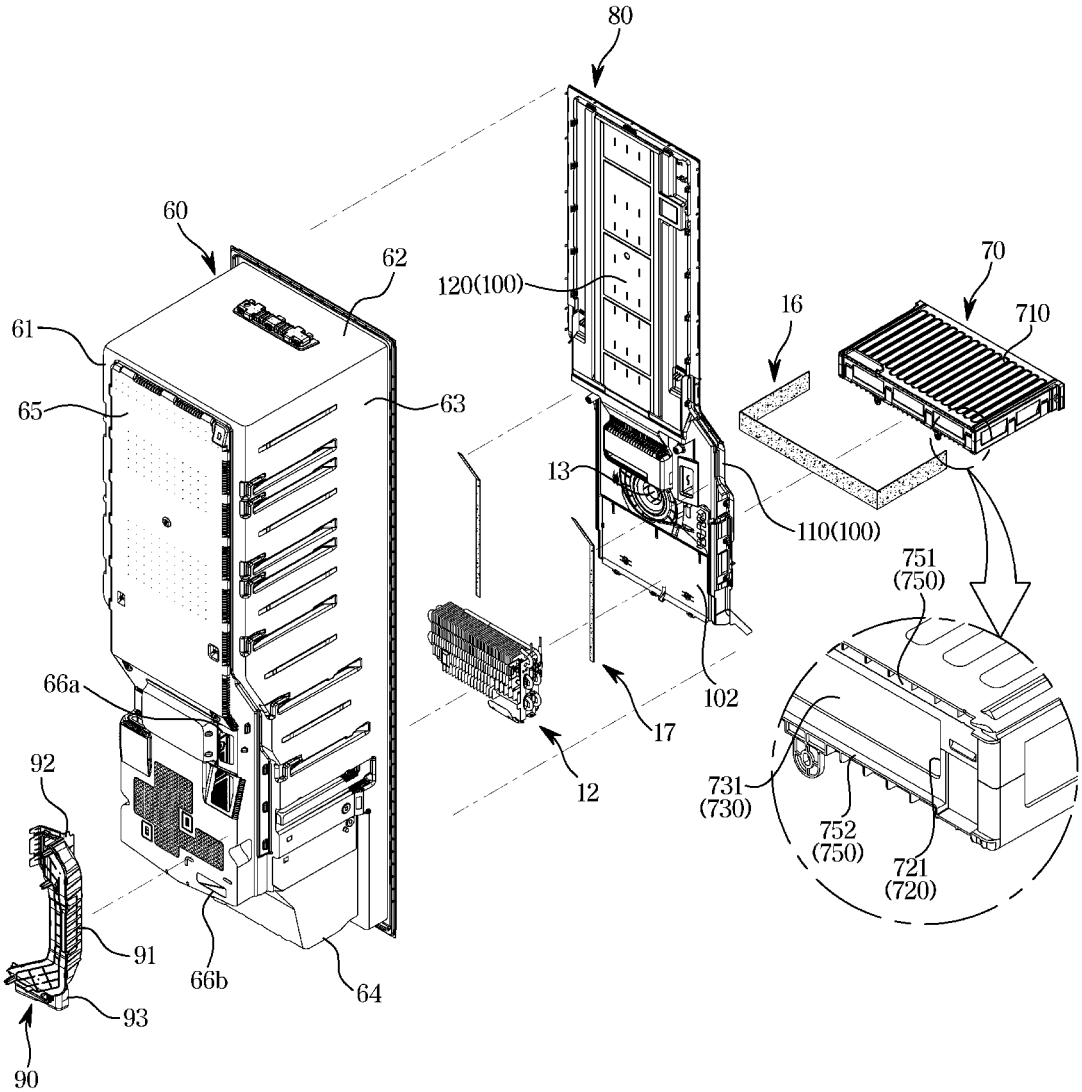
FIG. 6 is an exploded perspective view of some configurations of the refrigerator shown in FIG. 5 from the rear.

FIG. 4 is a perspective view of some components of the refrigerator according to an embodiment of the disclosure. FIG. 5 is an exploded perspective view of some components of the refrigerator shown in FIG. 4. FIG. 6 is an exploded perspective view of some configurations of the refrigerator shown in FIG. 5 from the rear.

The inner case 60 may not be divided into a refrigerating compartment inner case and a freezing compartment inner case (see FIGS. 5 and 6). In other words, the inner case 60 may form the storage compartment 20 provided as a single space. That is, the storage compartment 20 may be formed as one space and may not be divided into a storage compartment formed by the refrigerating compartment inner case and a storage compartment formed by the freezing compartment inner case. The storage compartment 20 may be partitioned by the partition 70 into a plurality of compartments. Each of the plurality of compartments may be referred to in different ways according to the temperature to be implemented.

The duct 80 may be disposed within the storage compartment 20. The duct 80 may be disposed behind the partition 70 on the inner side of the inner case 60. For example, at least a portion of duct 80 may be disposed at a front side of the evaporator 12.

The duct 80 may be detachably mounted on the inner side of the inner case 60. For example, the duct 80 may be detachably coupled to the rear wall 65 and/or the two side walls 61 and 63 of the inner case 60.

The duct 80 may extend in a vertical direction (Z direction) of the main body 10. The duct 80 may extend along the vertical direction (Z direction) of the inner case 60. The duct 80 may extend along the vertical direction (Z direction) of the storage compartment 20. The duct 80 may extend along an upward and downward direction (Z direction). The duct 80 may extend along a height direction of the storage compartment 20 between the evaporator 12 and the partition 70. One portion of the duct 80 may correspond to the refrigerating compartment 21 and the other portion of the duct 80 may correspond to the freezing compartment 22. One portion of the duct 80 may be exposed to the refrigerating compartment 21 and the other portion of the duct 80 may be exposed to the freezing compartment 22.

The duct 80 may include a first coupling portion 500 provided to couple the duct 80 with the partition 70 (see FIG. 5). The first coupling portion 500 may be formed on a side of the duct 80 facing the partition 70. For example, the first coupling portion 500 may be formed on the front surface of the duct 80. The first coupling portion 500 may correspond to a second coupling portion 750 of the partition 70, which will be described later. The first coupling portion 500 may be detachably coupled to the second coupling portion 750 of the partition 70 to be described later. Details thereof will be described later.

The evaporator 12 may be disposed in the storage compartment 20. For example, the evaporator 12 may be disposed between the duct 80 and the inner case 60. The evaporator 12 may be disposed the rear side of the duct 80. The evaporator 12 may be disposed in front of the rear wall 65 of the inner case 60. The evaporator 12 may be disposed in the cooling chamber 20*b* (see FIG. 2). The evaporator 12 may be provided to heat exchange with the cool air flowing into the cooling chamber 20*b*. The evaporator 12 may be provided to heat exchange with the cool air flowing into the cooling chamber 20*b* after being recovered from the refrigerating compartment 21. The evaporator 12 may be provided to heat exchange with the cool air flowing into the cooling chamber 20*b* after being recovered from the freezing compartment 22.

The partition 70 may be disposed in front of the duct 80. The partition 70 may be detachably mounted on the duct 80. For example, the partition 70 may be detachably coupled to the front surface of the duct 80.

The partition 70 may include the second coupling portion 750 provided to couple the partition 70 with the duct 80 (see FIG. 6). The second coupling portion 750 may be formed on a side of the partition 70 facing the duct 80. For example, the second coupling portion 750 may be formed on a rear surface of the partition 70. The second coupling portion 750 may correspond to the first coupling portion 500 of the duct 80. The second coupling portion 750 may be detachably coupled to the first coupling portion 500 of the duct 80. Details thereof will be described later.

For example, one of the first coupling portion 500 and the second coupling portion 700 may include a coupling protrusion, and the other one of the first coupling portion 500 and the second coupling portion 700 may include a coupling groove corresponding to the coupling protrusion.

The partition 70 may be detachably mounted on the main body 10. The partition 70 may be detachably mounted on the inner case 60. For example, the partition 70 may be detachably coupled to at least one of the left wall 63 and the right wall 61 of the inner case 60.

For example, the inner case 60 may include a partition mounting portion 67 to which the partition 70 is detachably coupled. For example, the partition mounting portion 67 may be formed on at least one of both side walls 61 and 63 of the inner case 60. For example, the partition mounting portion 67 may include a rail 671. For example, the partition 70 may slide along the rail 671. For example, the partition 70 may be provided to allow the partition 70 to be drawn into and withdrawn from the inner case 60. For example, the partition mounting portion 67 may include a first support protrusion 672 formed on an upper side of the rail 671 to support an upper surface of the partition 70. For example, the partition mounting portion 67 may include a second support protrusion 673 formed on a lower side of the rail 671 to support a lower surface of the partition 70. However, the disclosure is not limited to the above example, and the inner case 60 may have various shapes so that the partition 70 may be mounted.

As a position for mounting the partition 70 varies, a ratio of the refrigerating compartment 21 and the freezing compartment 22 may be varied. This allows users to set the refrigerating compartment 21 and the freezing compartment 22 at a desired ratio. For example, if there are more refrigerated foods than frozen foods, the space of the freezing compartment 22 may be reduced to ensure the space of the refrigerating compartment 21. For example, if there are more frozen foods than refrigerated foods, the space of the refrigerating compartment 21 may be reduced to ensure the space of the freezing compartment 22. Accordingly, the convenience of use of the refrigerator 1 may be improved.

The cool air connector 90 may be disposed behind the inner case 60. The cool air connector 90 may be detachably mounted on the outer side of the inner case 60. The cool air connector 90 may be detachably coupled to the rear wall 65 of the inner case 60.

The cool air connector 90 may extend along a direction of the arrangement of the refrigerating compartment 21 and the freezing compartment 22. For example, the cool air connector 90 may have a shape extending in the vertical direction (Z direction). However, the disclosure is not limited thereto, and when the refrigerating compartment 21 and the freezing compartment 22 are arranged side by side, the cool air connector 90 may have a shape extending along a left-right direction (Y direction).

For example, the cool air connector 90 may include a connector body 91 forming an exterior of the cool air connector 90. A flow path through which cool air flows may be formed within the connector body 91.

For example, the cool air connector 90 may include an inlet 92 formed on one side of the connector body 91. The inlet 92 may include an inlet hole 921 provided to receive the cool air recovered from the refrigerating compartment 21. The inlet hole 921 may be provided to communicate with the refrigerating compartment 21. The inlet hole 921 may be provided to communicate with a first recovery flow path 330. The inlet hole 921 may be provided to communicate with a first guide hole 66*a* formed in the rear wall 65 of the inner case 60.

For example, the cool air connector 90 may include an outlet 93 formed on the other side of the connector body 91. The outlet 93 may include an outlet hole 931 provided to discharge the cool air introduced into the cool air connector 90 into the cooling chamber 20*b*. The outlet hole 931 may be provided to communicate with the cooling chamber 20*b*. The outlet hole 931 may be provided to communicate with the second guide hole 66*b* formed in the rear wall 65 of the inner case 60.

The refrigerator 1 may include a first sealing member 16. The first sealing member 16 may be provided between the partition 70 and the duct 80. For example, the first sealing member 16 may be provided between the rear surface of the partition 70 and the front surface of the duct 80. For example, the first sealing member 16 may be provided to cover the rear of the partition 70. For example, the first sealing member 16 may be provided to cover the rear and sides of the partition 70. For example, the first sealing member 16 may be attached to the partition 70, and the partition 70 to which the first sealing member 16 is attached may be mounted on the duct 80. The first sealing member 16 may be provided as part of the partition 70.

The first sealing member 16 may be provided to seal between the partition 70 and the duct 80. The first sealing member 16 may be provided to prevent cool air from flowing between the partition 70 and the duct 80. When the partition 70 divides the storage compartment 20 into the refrigerating compartment 21 and the freezing compartment 22, the first sealing member 16 may be provided to prevent heat exchange between the refrigerating compartment 21 and the freezing compartment 22. When the partition 70 divides the storage compartment 20 into the refrigerating compartment 21 and the freezing compartment 22, the first sealing member 16 may be provided to prevent cool air from the freezing compartment 22 from flowing into the refrigerating compartment 21.

The first sealing member 16 may include an insulating material. For example, a urethane foam insulation, an expanded polystyrene (EPS) insulation, a vacuum insulation panel, or the like may be used as the first sealing member 16. However, the disclosure is not limited thereto, and the first sealing member 16 may include different materials to improve thermal insulation performance.

The refrigerator 1 may include a second sealing member 17. The second sealing member 17 may be provided between the duct 80 and the inner case 60. For example, the second sealing member 17 may extend along a height direction of the duct 80. For example, the second sealing member 17 may be provided as a pair. For example, the second sealing member 17 may be attached to a rear body 120 of a duct body 100 of the duct 80, and the duct 80 to which the second sealing member 17 is attached may be mounted on the inner case 60. The second sealing member 17 may be provided as part of the duct 80.

The second sealing member 17 may be provided to seal between the duct 80 and the inner case 60. The second sealing member 17 may be provided to prevent cool air from flowing between the duct 80 and the inner case 60. When the partition 70 divides the storage compartment 20 into the refrigerating compartment 21 and the freezing compartment 22, the second sealing member 17 may be provided to prevent heat exchange between the refrigerating compartment 21 and the freezing compartment 22. When the partition 70 divides the storage compartment 20 into the refrigerating compartment 21 and the freezing compartment 22, the second sealing member 17 may be provided to prevent cool air from the freezing compartment 22 from flowing into the refrigerating compartment 21. It can be.

The second sealing member 17 may include an insulating material. For example, a urethane foam insulation, an EPS insulation, a vacuum insulation panel, or the like may be used as the second sealing member 17. However, the disclosure is not limited thereto, and the second sealing member 17 may include different materials to improve thermal insulation performance.

Figure 7:
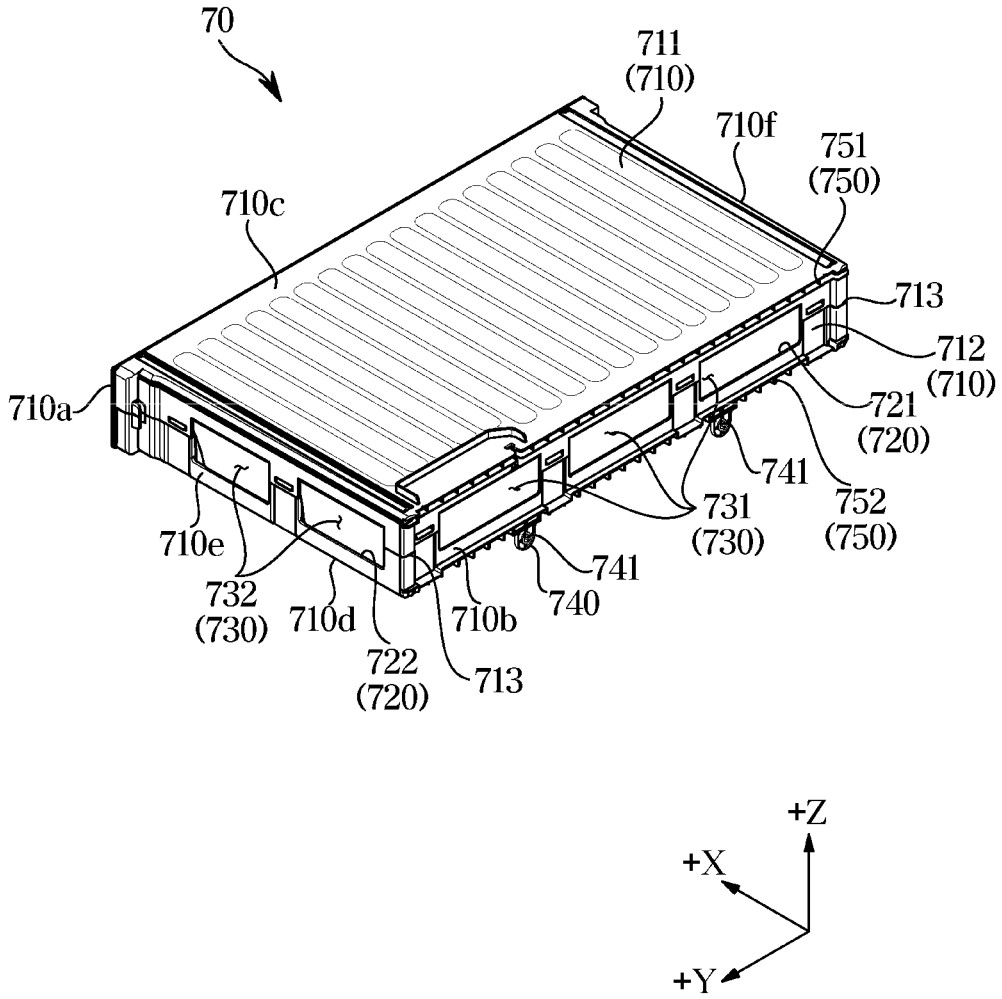
FIG. 7 is a perspective view illustrating an example of a partition according to an embodiment of the disclosure.
Figure 8:
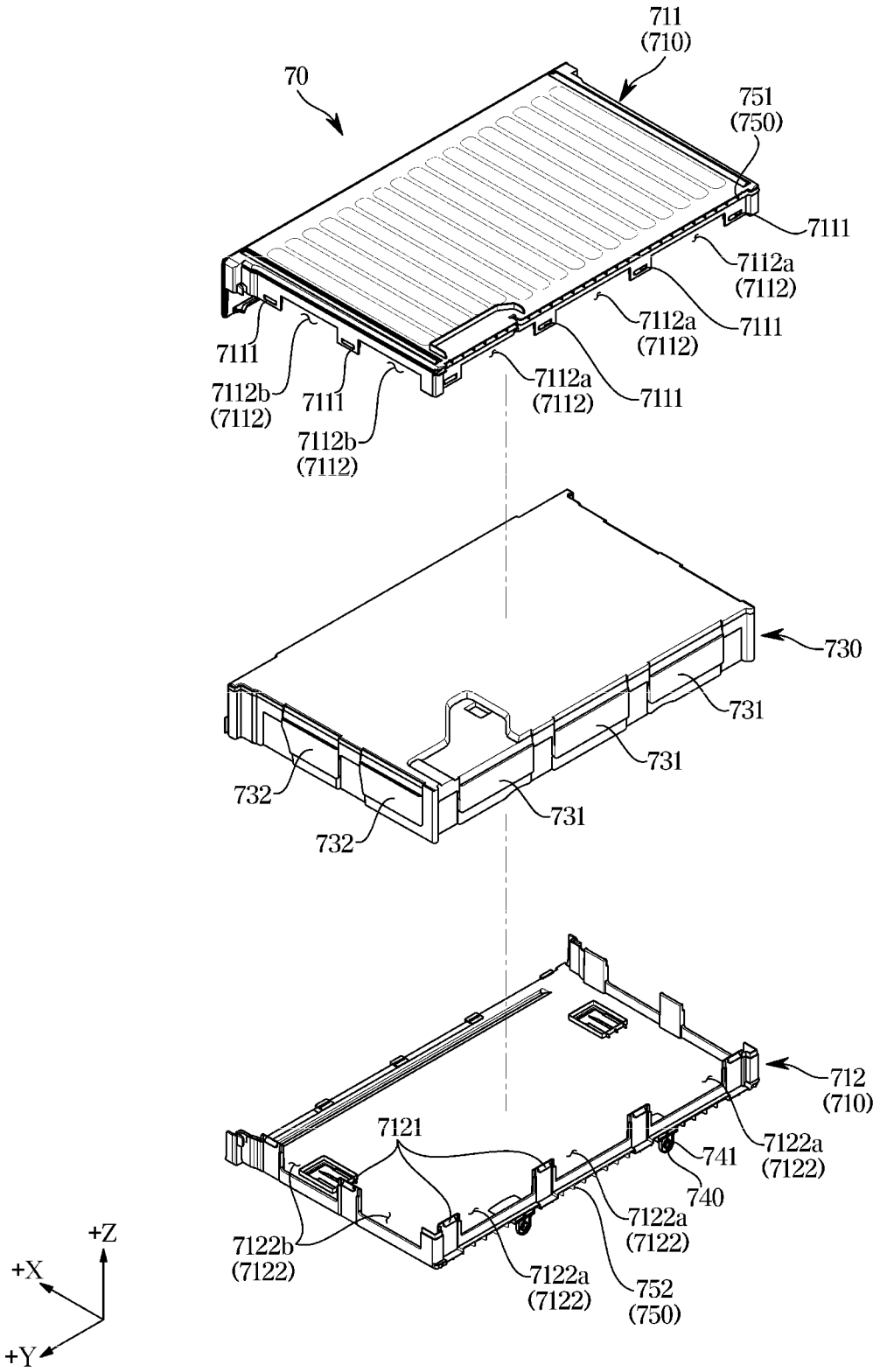
FIG. 8 is an exploded perspective view of the partition shown in FIG. 7.
Figure 9:
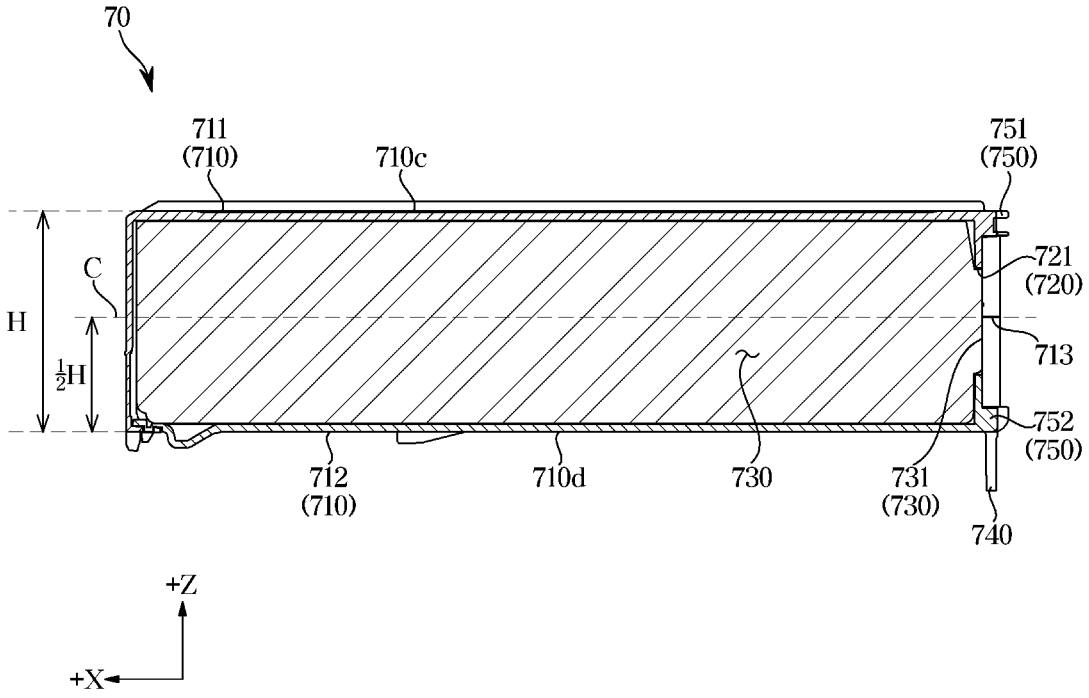
FIG. 9 is a cross-sectional side view of the partition shown in FIG. 7.

FIG. 7 is a perspective view of an example of the partition according to an embodiment of the disclosure. FIG. 8 is an exploded perspective view of the partition shown in FIG. 7. FIG. 9 is a cross-sectional side view of the partition shown in FIG. 7.

The partition 70 may include a partition body 710. The partition body 710 may be provided to form at least a portion of the exterior of the partition 70. The partition body 710 may be provided to accommodate a partition insulator 730, which will be described later. The partition body 710 may form a space in which the partition insulator 730 is provided.

The partition body 710 may also be referred to as the partition case 710, the partition housing 710, and the partition frame 710.

For example, the partition body 710 may have a substantially box shape. For example, the partition body 710 may include a front surface 710*a*, a rear surface 710*b*, an upper surface 710*c*, a lower surface 710*d*, a right surface 710*e*, and a left surface 710*f*.

The partition body 710 may be provided as one configuration or formed by assembling two or more configurations.

For example, the partition body 710 may include a first partition body 711 and a second partition body 712 detachably coupled to a lower portion of the first partition body 711. The partition body 710 may be formed by assembling the first partition body 711 and the second partition body 712.

For example, the first partition body 711 may include a first hook portion 7111, and the second partition body 712 may include a second hook portion 7121 engageable with the first hook portion 7111. For example, the first hook portion 7111 may be provided in a plurality, and the second hook portion 7121 may be provided in a plurality corresponding to the plurality of first hook portions 7111. In the drawings, it can be seen that the first hook portion 7111 may include a hook groove and the second hook portion 7121 may include a hook protrusion secured to the hook groove, but is not limited thereto. In contrast to what is shown, it is also possible that the second hook portion 7121 may include a hook groove, and the first hook portion 7111 may include a hook protrusion secured to the hook groove. In addition, the first partition body 711 and the second partition body 712 may be engaged by various known coupling methods.

Meanwhile, the disclosure is not limited to the above example, and the first partition body 711 and the second partition body 712 may be integrally formed.

For example, the partition body 710 may be manufactured by injection molding method. The partition body 710 may be referred to as the partition injection molding 710. For example, each of the first partition body 711 and the second partition body 712 may be manufactured by an injection molding method. The first partition body 711 may be referred to as the first injection molding 711. The second partition body 712 may be referred to as the second injection molding 712.

The partition 70 may include a partition hole 720. The partition hole 720 may be formed by cutting a portion of the partition body 710. The partition hole 720 may be formed by penetrating a portion of the partition body 710.

For example, at least one partition hole 720 may be provided. For example, the partition hole 720 may be provided in a plurality. For example, the plurality of partition holes 720 may be spaced apart from each other. For example, the plurality of partition holes 720 may be arranged along at least a portion of the circumference of the partition body 710.

For example, the partition holes 720 may include a first partition hole 721. The first partition hole 721 may be formed on a side of the partition body 710 facing the duct 80. The first partition hole 721 may be formed on the rear surface 710*b* of the partition body 710.

For example, the partition holes 720 may include a second partition hole 722. The second partition hole 722 may be formed on a side of the partition body 710 facing the right wall 61 of the inner case 60. The second partition hole 722 may be formed on a side of the partition body 710 facing the left wall 63 of the inner case 60. The second partition hole 722 may be formed on a side surface of the partition body 710. The second partition hole 722 may be formed on the right surface 710*e* of the partition body 710 and/or the left surface 710*f* of the partition body 710.

For example, the first partition body 711 may include a first cutting portion 7112, and the second partition body 712 may include a second cutting portion 7122. When the first partition body 711 and the second partition body 712 are assembled, the first cutting portion 7112 and the second cutting portion 7122 may form the partition hole 720.

For example, the first partition body 711 may include a first a cutting portion 7112*a*, and the second partition body 712 may include a second a cutting portion 7122*a*. When the first partition body 711 and the second partition body 712 are assembled, the first a cutting portion 7112*a* and the second a cutting portion 7122*a* may form the first partition hole 721.

For example, the first partition body 711 may include a first b cutting portion 7112*b*, and the second partition body 712 may include a second b cutting portion 7122*b*. When the first partition body 711 and the second partition body 712 are assembled, the first b cutting portion 7112*b* and the second b cutting portion 7122*b* may form the second partition hole 722.

The partition 70 may include the partition insulator 730. The partition insulator 730 may be disposed within the partition body 710. When the partition 70 divides the storage compartment 20 into the refrigerating compartment 21 and the freezing compartment 22, the partition insulator 730 may prevent heat exchange between the refrigerating compartment 21 and the freezing compartment 22.

For example, the partition insulator 730 may be a urethane foam insulation, an EPS insulation, a vacuum insulation panel, or the like. However, the disclosure is not limited thereto, and the partition insulator 730 may include different materials.

The partition insulator 730 may be exposed through the partition holes 720. A portion of the partition insulator 730 may be exposed to the outside of the partition body 710 through the partition holes 720.

The partition insulator 730 may include one or more first exposed portions 731. The first exposed portion 731 may each be exposed through the first partition hole 721. The first exposed portion 731 may be exposed toward the duct 80. The first exposed portion 731 may be exposed to the rear of the partition body 710 through the first partition hole 721. The first exposed portion 731 may be provided to face the duct body 100 of the duct 80. The first exposed portion 731 may be provided to be in close contact with the duct body 100 of the duct 80. The first exposed portion 731 may be provided to be in close contact with a third exposed portion 131, which will be described later, of a duct insulator 130 of the duct 80.

For example, the first exposed portion 731 may protrude backward through the first partition hole 721 (see FIG. 9). For example, the first exposed portion 731 may be provided to be connected to the rear surface 710*b* of the partition body 710 without a step. As a result, a contact area between the partition insulator 730 and the partition body 710 may be increased, and the assemblability of the partition 70 may be improved.

The partition insulator 730 may include a second exposed portion 732. The second exposed portion 732 may be exposed through the second partition hole 722. The second exposed portion 732 may be exposed toward at least one of the two side walls 61 and 63 of the inner case 60. The second exposed portion 732 may be exposed to a side of the partition body 710 through the second partition hole 722. The second exposed portion 732 may be provided to face at least one of the two side walls 61 and 63 of the inner case 60. The second exposed portion 732 may be provided to be in close contact with at least one of the two side walls 61 and 63 of the inner case 60.

For example, the second exposed portion 732 may protrude laterally through the second partition hole 722. For example, the second exposed portion 732 may be provided to be connected to the right surface 710*e* or the left surface 710*f* of the partition body 710 without a step. As a result, a contact area between the partition insulator 730 and the partition body 710 may be increased, and the assemblability of the partition 70 may be improved.

The refrigerating compartment 21 and the freezing compartment 22 may be formed as the storage compartment 20, which is a single space, is divided by the partition 70. This structure may result in cool air leakage and/or heat conduction between the refrigerating compartment 21 and the freezing compartment 22 due to a temperature difference between the refrigerating compartment 21 and the freezing compartment 22. In other words, the temperatures of the refrigerating compartment 21 and the freezing compartment 22 may not be constantly maintained. For example, the temperature of the freezing compartment 22 may increase. To prevent heat conduction between the refrigerating compartment 21 and the freezing compartment 22, the partition insulator 730 may include at least one exposed portion.

For example, the first exposed portion 731 of the partition insulator 730 may be exposed through the first partition hole 721 so as to be in close contact with the duct body 100 of the duct 80. As a result, not only the partition body 710 and the duct body 100 may come into contact with each other, but also the partition insulator 730 and the duct body 100 may come into contact with each other. At a portion where the partition insulator 730 and the duct body 100 come into contact, cool air leakage and/or heat conduction between the refrigerating compartment 21 and the freezing compartment 22 may be effectively prevented.

For example, each of the partition body 710 and the duct body 100 may be provided as an injection molding. When there is a portion where the partition insulator 730 and the duct body 100 are in contact, the thermal conductivity may be lower than where the injection moldings 710 and 100 are in entire contact with each other. For example, the surface of the partition insulator 730 may be rougher than the surface of each of the partition body 710 and the duct body 100. As the surface of the partition insulator 730 is provided with a relatively rough surface, vortexes may occur in response to cool air flowing between the partition 70 and the duct 80. Accordingly, cool air in the freezing compartment 22 may have difficulty flowing between the partition 70 and the duct 80. For example, the partition insulator 730 may be made of a material more flexible than each of the partition body 710 and the duct body 100. Accordingly, when there is a portion where the partition insulator 730 and the duct body 100 are in contact, the sealing force may be improved compared to when the partition body 710 and the duct body 100 are in entire contact with each other. Consequently, the partition 70 may effectively prevent leakage of cool air and/or heat conduction between the refrigerating compartment 21 and the freezing compartment 22 by including the first exposed portion 731. Accordingly, the temperatures of the refrigerating compartment 21 and the freezing compartment 22 may be maintained constant, and thus the cooling efficiency of the refrigerator 1 may be improved.

For example, the second exposed portion 732 of the partition insulator 730 may be exposed through the second partition hole 722 so as to be in close contact with the inner case 60. As a result, not only the partition body 710 and the inner case 60 may come into contact with each other, but also the partition insulator 730 and the inner case 60 may come into contact with each other. That is, a portion where the partition insulator 730 and the inner case 60 are in contact may occur. As described above for the first exposed portion 731 of the partition 70, the thermal conductivity between the inner case 60 and the partition 70 may be reduced because the partition 70 includes the second exposed portion 732. Leakage of cool air between the inner case 60 and the partition 70 may be effectively prevented because the partition 70 includes the second exposed portion 732. In addition, the airtightness between the inner case 60 and the partition 70 may be improved because the partition 70 includes the second exposed portion 732. As a result, the temperatures of the refrigerating compartment 21 and the freezing compartment 22 may be maintained constant, and thus the cooling efficiency of the refrigerator 1 may be improved.

The partition 70 may include a parting line 713. For example, the parting line 713 may be formed by coupling the first partition body 711 with the second partition body 712.

For example, the parting line 713 may be provided to be positioned at approximately ½ of a height H of the partition body 710 or below approximately ½ of the height H of the partition body 710. For example, the parting line 713 may be positioned on a center line C of the partition 70 or below the center line C. The center line C of the partition 70 may include a horizontal line passing through the center of upper and lower surfaces 710*c* and 710*d* of the partition body 710. For example, the parting line 713 may be provided closer to the freezing compartment 22 than the refrigerating compartment 21. As a result, the parting line 713 may prevent heat conduction between the refrigerating compartment 21 and the freezing compartment 22 as much as possible.

For example, the first partition body 711 may be adjacent to the refrigerating compartment 21 and the second partition body 712 may be adjacent to the freezing compartment 22. Cool air in the freezing compartment 22 may be conducted to the refrigerating compartment 21 through the second partition body 712 and the first partition body 711. The parting line 713 may define the first partition body 711 and the second partition body 712, and be provided to prevent heat conduction between the first partition body 711 and the second partition body 712. As a result, the parting line 713 may be arranged to be located at the center of a region between the refrigerating compartment 21 and the freezing compartment 22 or adjacent to the freezing compartment 22 to prevent as much cool air as possible from being transferred from the freezing compartment 22 to the refrigerating compartment 21. As the parting line 713 is located at a relatively lower position than when the parting line 713 is adjacent to the refrigerating compartment 21, the amount of cool air transferred from the freezing compartment 22 to the refrigerating compartment 21 may be relatively small.

However, the disclosure is not limited to the above example, and the position of the parting line 713 may vary as needed. For example, when the freezing compartment is positioned above the refrigerating compartment, the parting line 713 may be provided to be positioned at approximately ½ of the height H of the partition body 710 or above approximately ½ of the height H of the partition body 710. For example, when the freezing compartment is positioned above the refrigerating compartment, the parting line 713 may be positioned on the center line C of the partition 70 or above the center line C.

The partition 70 may include the second coupling portion 750. The second coupling portion 750 may be provided to be coupled with the first coupling portion 500 of the duct 80. The second coupling portion 750 may be formed on the rear surface 710*b* of the partition body 710.

For example, the second coupling portion 750 may include one or more upper protrusions 751 and one or more lower protrusions 752 spaced downward from the one or more upper protrusions 751.

The upper protrusion 751 of the second coupling portion 750 may each protrude toward the duct 80. The upper protrusion 751 of the second coupling portion 750 may have a shape protruding backward. The upper protrusion 751 of the second coupling portion 750 may protrude backward from the rear surface 710*b* of the partition body 710. For example, the upper protrusion 751 of the second coupling portion 750 may have a shape extending in the left-right direction (Y direction).

The upper protrusion 751 of the second coupling portion 750 may be provided to correspond to an upper groove 510 of the first coupling portion 500 to be described later. The upper protrusion 751 of the second coupling portion 750 may be detachably coupled to the upper groove 510 of the first coupling portion 500. The upper protrusion 751 of the second coupling portion 750 may be provided to be inserted into the upper groove 510 of the first coupling portion 500.

The lower protrusion 752 of the second coupling portion 750 may each protrude toward the duct 80. The lower protrusion 752 of the second coupling portion 750 may have a shape protruding backward. The lower protrusion 752 of the second coupling portion 750 may protrude backward from the rear surface 710*b* of the partition body 710. For example, the lower protrusion 752 of the second coupling portion 750 may have a shape extending in the left and right direction (Y direction).

The lower protrusion 752 of the second coupling portion 750 may be provided to correspond to a lower groove 520 of the first coupling portion 500 to be described later. The lower protrusion 752 of the second coupling portion 750 may be detachably coupled to the lower groove 520 of the second coupling portion 750. The lower protrusion 752 of the second coupling portion 750 may be inserted into the lower groove 520 of the second coupling portion 750.

The upper protrusion 751 may also be referred to as the first coupling protrusion 751. The lower protrusion 752 may also be referred to as the second coupling protrusion 752.

The partition 70 may include one or more fastening bodies 740. The fastening bodies 740 may be provided to maintain a fastening force between the first coupling portion 500 and the second coupling portion 750. The fastening bodies 740 may be detachably coupled to the duct 80. The fastening bodies 740 may be provided in close contact with the duct body 100 of the duct 80. The fastening bodies 740 may extend from the partition body 710. In the drawings, the fastening bodies 740 are illustrated as extending downward from the lower surface 710*d* of the partition body 710, but is not limited thereto. The fastening bodies 740 may extend from a portion of the partition body 710 and fasten to the duct 80, but is not limited in shape and arrangement.

For example, the fastening bodies 740 may be provided to be screw-coupled with the duct 80. For example, the fastening bodies 740 may include a first fastening hole 741, and the duct 80 may include one or more second fastening holes 140. The fastening member (not shown) may be provided to be fastened to the first fastening hole 741 and the second fastening hole 140 in a state where the first fastening hole 741 and the second fastening hole 140 overlap.

Figure 10:
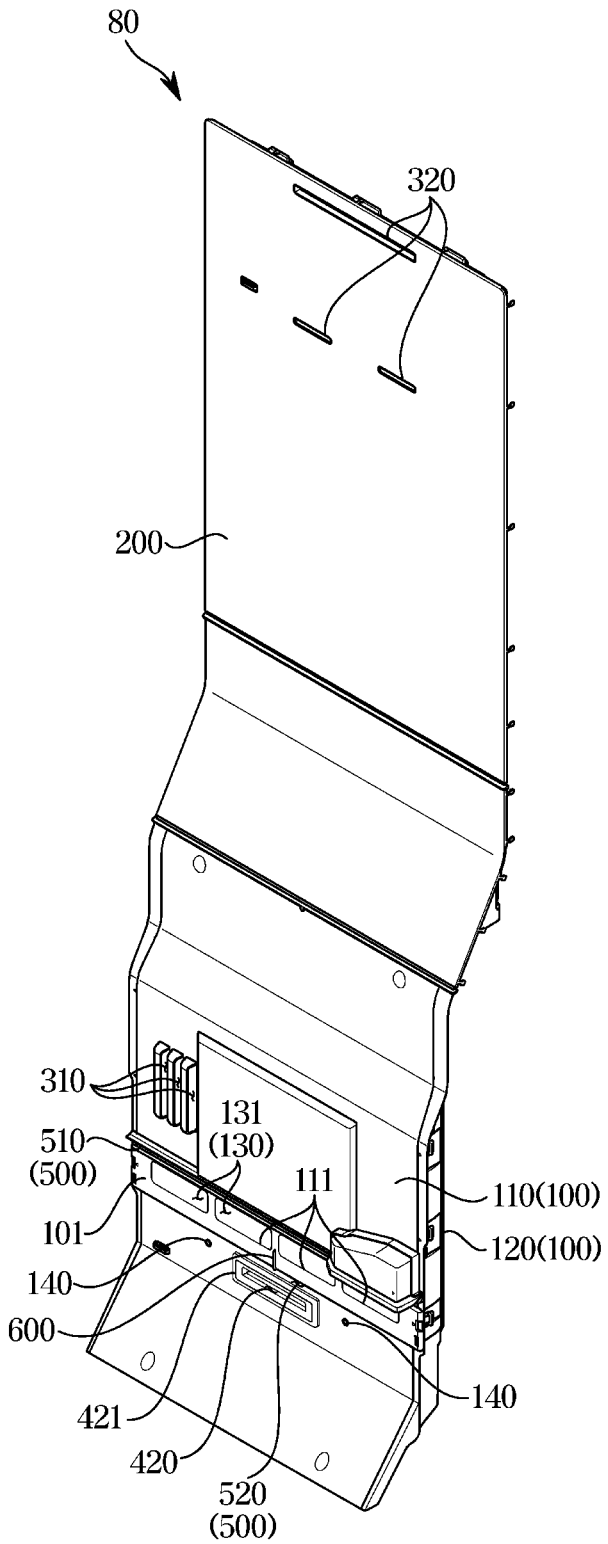
FIG. 10 is a perspective view illustrating an example of a duct according to an embodiment of the disclosure.
Figure 11:
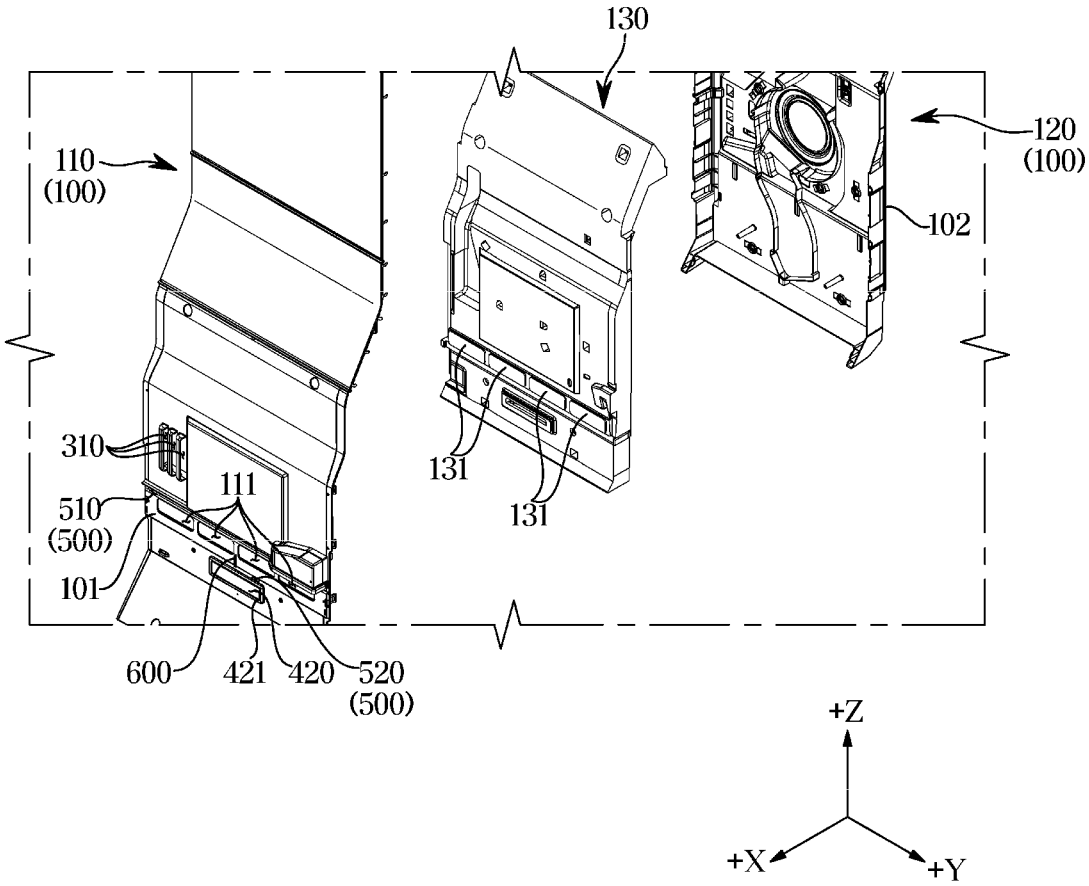
FIG. 11 is an exploded perspective view of a part of the duct shown in FIG. 10.
Figure 12:
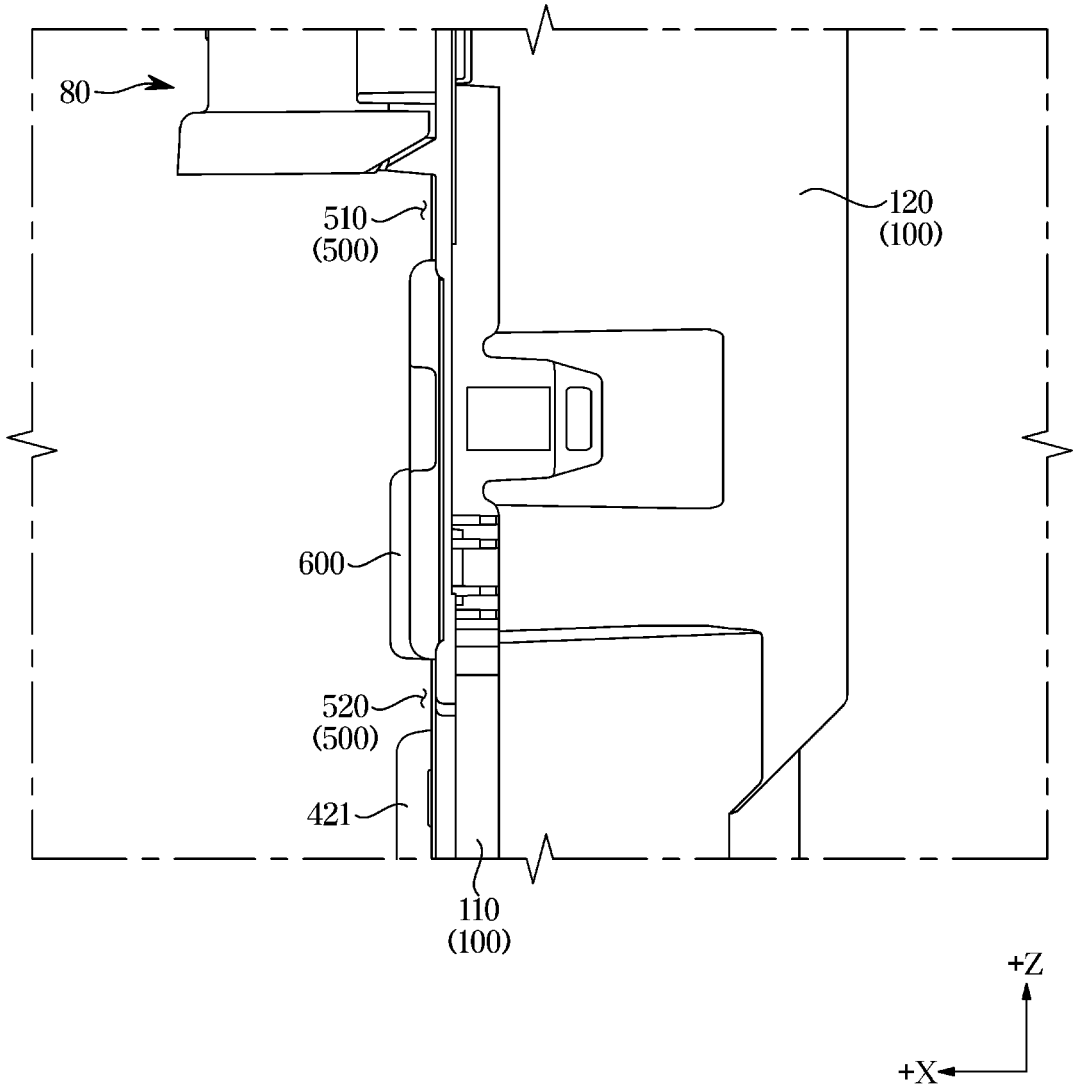
FIG. 12 is an enlarged side view of a part of the duct shown in FIG. 10.
Figure 13:
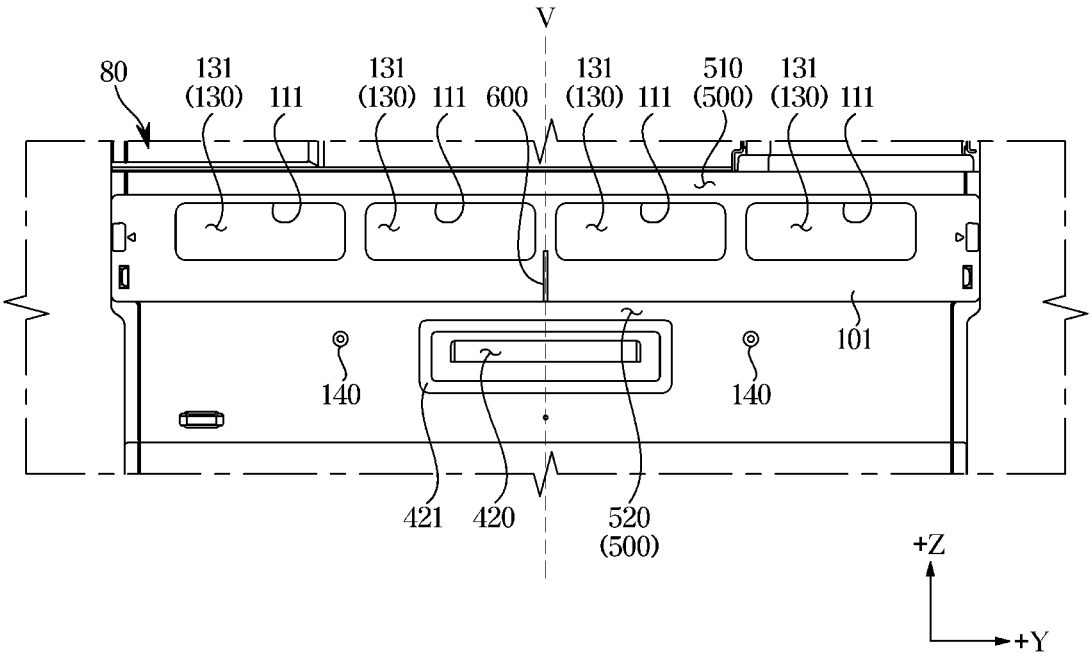
FIG. 13 is an enlarged front view of a part of the duct shown in FIG. 10.

FIG. 10 is a perspective view of an example of the duct according to an embodiment of the disclosure. FIG. 11 is an exploded perspective view of a part of the duct shown in FIG. 10. FIG. 12 is an enlarged side view of a part of the duct shown in FIG. 10. FIG. 13 is an enlarged front view of a part of the duct shown in FIG. 10.

The duct 80 may include the duct body 100. The duct body 100 may form at least a portion of the exterior of the duct 80. The duct body 100 may form a flow path through which cool air flows.

For example, the duct body 100 may include a front body 110 and a rear body 120.

The front body 110 may be coupled to the front of the rear body 120. The front body 110 may be provided to face the storage compartment 20. The front body 110 may be provided to be exposed toward the storage compartment 20. The front body 110 may be provided to face the refrigerating compartment 21 and the freezing compartment 22. The front body 110 may be exposed toward the refrigerating compartment 21 and the freezing compartment 22. For example, the front body 110 may form the front surface of the duct 80. A front surface 101 of the front body 110 may be the front surface of the duct 80.

The rear body 120 may be coupled to the rear of the front body 110. The rear body 120 may be provided to face a rear surface of the inner case 60. The rear body 120 may be disposed to face the rear wall 65 of the inner case 60. In a state where the duct 80 is mounted on the inner case 60, the rear body 120 may be covered by the front body 110 and not exposed to the storage compartment 20. For example, the rear body 120 may form a rear surface of the duct 80. The rear surface 102 of the rear body 120 may be the rear surface of the duct 80.

The front body 110 may be detachably coupled to the rear body 120. However, the disclosure is not limited thereto, and the front body 110 and the rear body 120 may be provided as a unitary form.

For example, the duct body 100 may be manufactured by injection molding. The duct body 100 may be referred to as the duct injection molding 100. For example, the front body 110 and the rear body 120 may be individually manufactured by injection molding. For example, the front body 110 may be referred to as the front injection molding 110. For example, the rear body 120 may be referred to as the rear injection molding 120.

The duct body 100 may include duct holes 111. The duct holes 111 may be formed by cutting a portion of the duct body 100. The duct holes 111 may be formed by penetrating a portion of the duct body 100.

For example, the duct holes 111 may be formed on a side of the duct body 100 facing the partition 70. For example, the duct holes 111 may be formed in the front body 110. For example, the duct holes 111 may be formed as a portion of the front body 110 is penetrated. For example, the duct holes 111 may be formed on a front surface of the duct body 100.

The duct 80 may include the duct insulator 130. At least a portion of the duct insulator 130 may be provided within the duct body 100. The duct insulator 130 may be disposed between the front body 110 and the rear body 120. The duct insulator 130 may be provided to support at least one of the front body 110 and the rear body 120. The duct insulator 130 may be provided to fix the front body 110 to the rear body 120. For example, when the front body 110 is coupled to the rear body 120, the duct insulator 130 may be provided to be in surface contact with at least one of the front body 110 and the rear body 120.

The duct insulator 130 may be provided to block cool air flowing in the duct 80. The duct insulator 130 may prevent the cool air flowing in the duct 80 from leaking out of the duct 80. The duct insulator 130 may be provided to insulate between the front body 110 and the rear body 120. The duct insulator 130 may prevent heat exchange from occurring between the front body 110 and the rear body 120. Accordingly, the temperature of the cool air flowing in the duct 80 may be maintained constant.

For example, the duct insulator 130 may include at least one of an EPS insulation, a urethane foam insulation, and a vacuum insulation panel. However, the disclosure is not limited thereto, and the duct insulator 130 may include different materials to improve the insulation performance of the duct 80.

The duct insulator 130 may be exposed through the duct holes 111. A portion of the duct insulator 130 may be exposed to the outside of the duct body 100 through the duct holes 111.

The duct insulator 130 may include one or more third exposed portions 131. The third exposed portions 131 may be exposed through the duct holes 111. The third exposed portions 131 may be exposed to the partition 70. The third exposed portions 131 may be exposed to the front side of the duct 80 through the duct holes 111. The third exposed portions 131 may be provided to face the partition body 710. The third exposed portions 131 may be provided to face the rear surface **710*b* of the partition body 710. The third exposed portions 131 may be provided to be in close contact with the partition body 710. The third exposed portions 131 may be provided to be in close contact with the first exposed portion 731 of the partition insulator 730 of the partition 70**.

In summary, the third exposed portions 131 of the duct insulator 130 may be provided to be in close contact with the partition 70 through the duct holes 111. Accordingly, not only the duct body 100 and the partition 70 may be in contact with each other, but also the duct insulator 130 and the partition 70 may be in contact with each other.

As described above for the first exposed portion 731 and the second exposed portion 732 of the partition 70, the duct insulator 130 may include the third exposed portions 131, and thus the thermal conductivity between the duct 80 and the partition 70 may be reduced. The duct insulator 130 may include the third exposed portions 131, and thus leakage of cool air between the duct 80 and the partition 70 may be effectively prevented. The duct insulator 130 may include the third exposed portions 131, and thus the airtightness between the duct 80 and the partition 70 may be improved.

For example, the third exposed portions 131 may be provided to protrude forward through the duct holes 111. For example, the third exposed portions 131 may be provided to be connected to the front surface of the duct body 100 without a step. For example, the third exposed portions 131 may be provided to be connected to the front surface 101 of the front body 110 without a step. As a result, a contact area between the duct insulator 130 and the duct body 100 may be increased, and the assemblability of the duct 80 may be improved.

The duct 80 may include the first coupling portion 500. The first coupling portion 500 may be provided to be coupled with the second coupling portion 750 of the partition 70. The first coupling portion 500 may be formed on the front surface of the duct body 100. The first coupling portion 500 may be formed on the front body 110.

For example, the first coupling portion 500 may include the upper groove 510 and the lower groove 520 spaced downward from the upper groove 520.

The upper groove 510 of the first coupling portion 500 may have a shape that is recessed backward. The upper groove 510 of the first coupling portion 500 may be formed by recessing a portion of the front surface of the duct body 100.

The upper groove 510 of the first coupling portion 500 may be provided to correspond to the upper protrusion 751 of the second coupling portion 750. The upper groove 510 of the first coupling portion 500 may be detachably coupled to the upper protrusion 751 of the second coupling portion 750. The upper groove 510 of the first coupling portion 500 may be provided to accommodate the upper protrusion 751 of the second coupling portion 750.

The lower groove 520 of the first coupling portion 500 may have a shape that is recessed backward. The lower groove 520 of the first coupling portion 500 may be formed by recessing a portion of the front surface of the duct body 100.

For example, the lower groove 520 may have a relatively depressed shape as the border 421 of the outlet 420 protrudes. However, the disclosure is only an example, and is not limited thereto.

The lower groove 520 of the first coupler 500 may be provided to correspond to the lower protrusion 752 of the second coupling portion 750. The lower groove 520 of the first coupling portion 500 may be detachably coupled to the lower protrusion 752 of the second coupling portion 750. The lower groove 520 of the first coupling portion 500 may be provided to accommodate the lower protrusion 752 of the second coupling portion 750.

The upper groove 510 may also be referred to as the first coupling groove 510. The lower groove 520 may also be referred to as the second coupling groove 520.

The duct 80 may include the second fastening holes 140. As fastening members (not shown) are fastened to the first fastening hole 741 and the second fastening hole 140, the partition 70 and the duct 80 may be more stably coupled.

The duct 80 may include a cover plate 200 arranged in front of the duct body 100. The cover plate 200 may be detachably mounted on the front surface of the front body 110. The cover plate 200 may be provided to cover at least a portion of the front body 110. The cover plate 200 may be provided to be exposed to the storage compartment 20. However, if the cover plate 200 is omitted, the front body 110 may be exposed to the storage compartment 20.

The design of the cover plate 200 may freely changeable. Accordingly, when the design of the cover plate 200 is changed, the exterior design of the duct 80 and the interior design of the refrigerator 1 may be implemented differently. The cover plate 200 may be freely replaced by a user as needed.

The duct 80 may include a protrusion 600. The protrusion 600 may be formed on the duct body 100. The protrusion 600 may protrude forward from the duct body 100. The protrusion 600 may protrude toward the partition 70 from the front surface of the duct body 100.

The protrusion 600 may be provided to press the partition 70. The protrusion 600 may press the partition 70 in a state in which the second coupling portion 750 of the partition 70 is coupled to the first coupling portion 500 of the duct 80. The protrusion 600 may be provided to press the rear surface side of the partition 70. The protrusion 600 may be provided to press the rear surface 710*b* of the partition body 710. The protrusion 600 may be provided to press the first exposed portions 731 of the partition insulator 730 exposed through the first partition holes 720.

The protrusion 600 of the duct 80 may press the partition 70 forward in a state in which the duct 80 and the partition 70 are coupled to each other, and the partition 70 may press the duct 80 backward by a repulsive force.

As a result, the duct 80 and the partition 70 may come into closer contact, and the cool air flow between the duct 80 and the partition 70 may be reduced or prevented.

Furthermore, the force of the partition 70 pressing against the duct 80 may prevent a gap from being generated between the duct body 100 and the duct insulator 130. By the force of the partition 70 pressing against the duct 80, the duct body 100 and the duct insulator 130 may be brought into closer contact.

For example, the duct 80 may be coupled to the inner case 60 with the second sealing member 17 attached thereto. For example, the pair of the second sealing members 17 may be attached to the side or rear surfaces of the duct 80. For example, in a state where the duct 80 is mounted on the inner case 60, the duct body 100 may be bent by the repulsive force of the second sealing member 17, causing a gap between the duct body 100 and the duct insulator 130 to occur. For example, the front body 110 may be curved such that a central portion of the front surface protrudes convexly, creating the gap between the front body 110 and the duct insulator 130. As described above, the protruding portion 600 may press the partition 70, and thus the duct body 100 and the duct insulator 130 may come into close contact with each other. As the protruding portion 600 presses the partition 70 forward, the partition 70 may press the protruding portion 600 backward by the repulsive force, and thus the duct body 100 and the duct insulator 130 may come into close contact with each other. As a result, the protrusion 600 may prevent the gap between the duct body 100 and the duct insulator 130 from being formed.

For example, the protrusion 600 may be disposed between the upper groove 510 and the lower groove 520. In the state in which the duct 80 and the partition 70 are coupled, the protrusion 600 may be provided to be positioned between a portion in which the upper groove 510 and the upper protrusion 751 are coupled together (hereinafter referred to as a first portion), and a portion in which the lower groove 520 and the lower protrusion 752 are coupled together (hereinafter referred to as a second portion). The protrusion 600 may be provided to press the partition 70 between the first portion and the second portion. The protruding part 600 may be provided to be brought into close contact with the partition 70 between the first portion and the second portion.

For example, the protrusion 600 may be disposed at the center of the duct body 100 in the left-right direction. For example, the protrusion 600 may be disposed on a vertical center line V of the duct body 100.

For example, the protrusion 600 may have a shape extending in the vertical direction (Z direction). However, the disclosure is not limited thereto, and the shape of the protrusion 600 is not limited as long as it may protrude to press the partition 70 in a state in which the duct 80 and the partition 70 are coupled.

Figure 14:
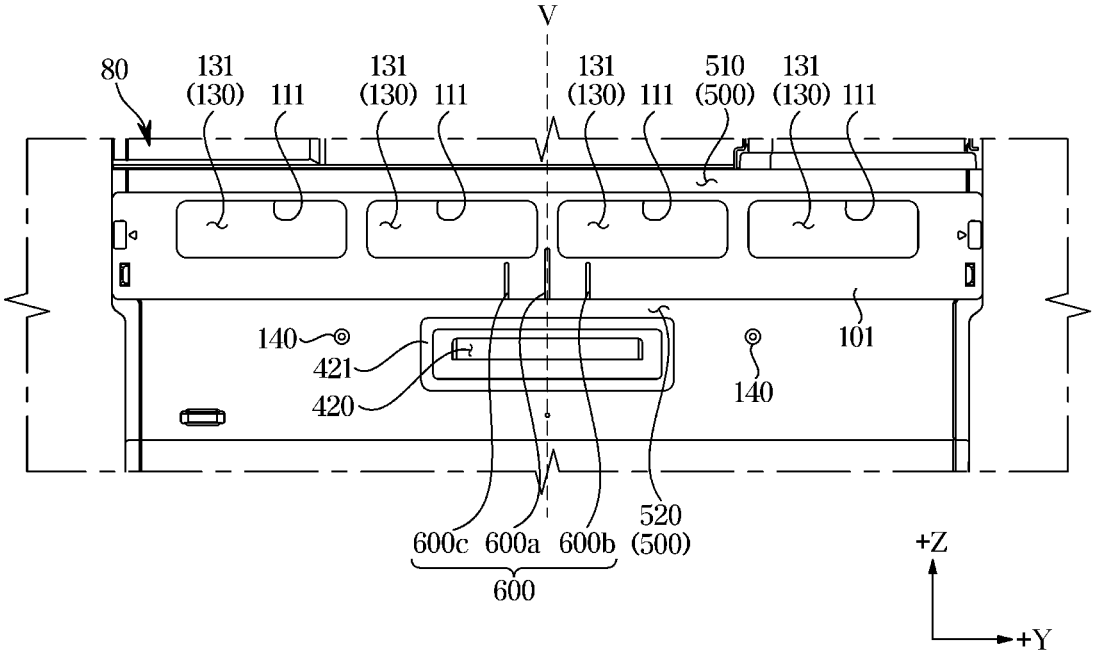
FIG. 14 is an enlarged front view of a part of the duct according to an embodiment of the disclosure.

FIG. 14 is an enlarged front view of a portion of the duct according to an embodiment of the disclosure.

Referring to FIG. 14, the protrusion 600 may be provided in a plurality. The plurality of protrusions 600*a*, 600*b*, and 600*c* may be spaced apart from each other. In FIG. 14, the plurality of protrusions 600*a*, 600*b*, and 600*c* is shown to be arranged along the left-right direction (Y direction), but are not limited thereto. For example, the plurality of protrusions 600*a*, 600*b*, and 600*c* may be arranged in the vertical direction (Z direction). Furthermore, the number of protrusions in FIG. 14 is shown as three (i.e., 600*a*, 600*b*, and 600*c*), but is not limited thereto. For example, the number of protrusions 600 may be two or less or four or more.

Figure 15:
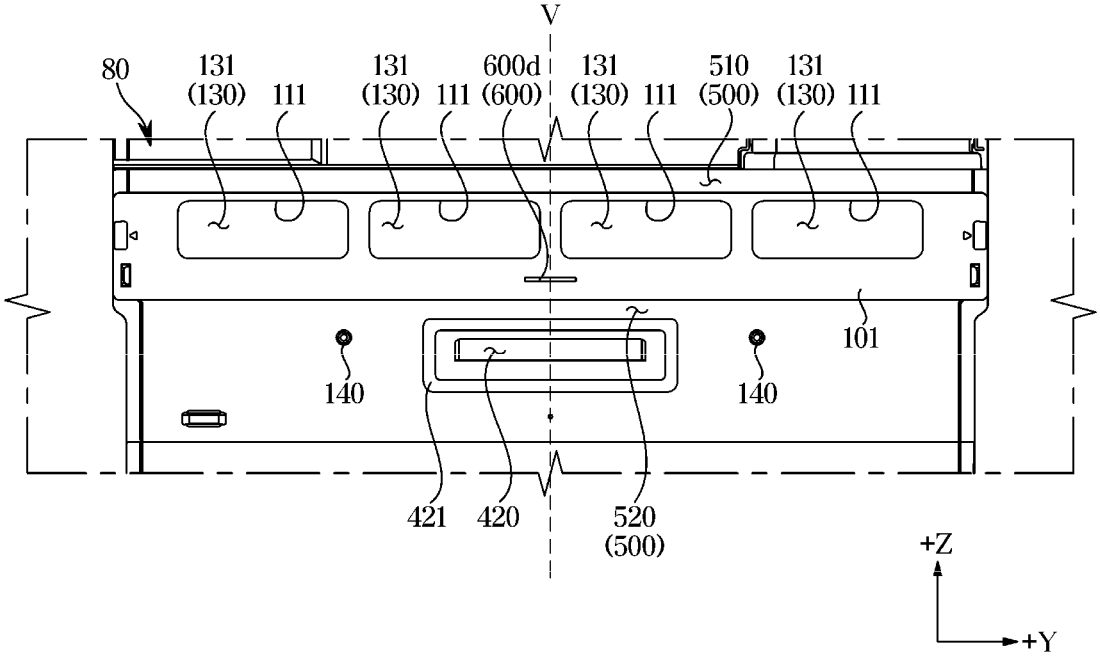
FIG. 15 is an enlarged front view of a part of the duct according to an embodiment of the disclosure.

FIG. 15 is an enlarged front view of a portion of the duct according to an embodiment of the disclosure.

Referring to FIG. 15, a protrusion 600*d* may have a shape extending in the left-right direction (Y direction). However, the disclosure is not limited thereto, and the protruding portion 600*d* may have a shape extending in different directions as long as it protrudes toward the partition 70. Furthermore, the protrusion 600*d* in FIG. 15 is shown as one, but is not limited thereto. For example, two or more protrusions 600*d* may be provided.

Figure 16:
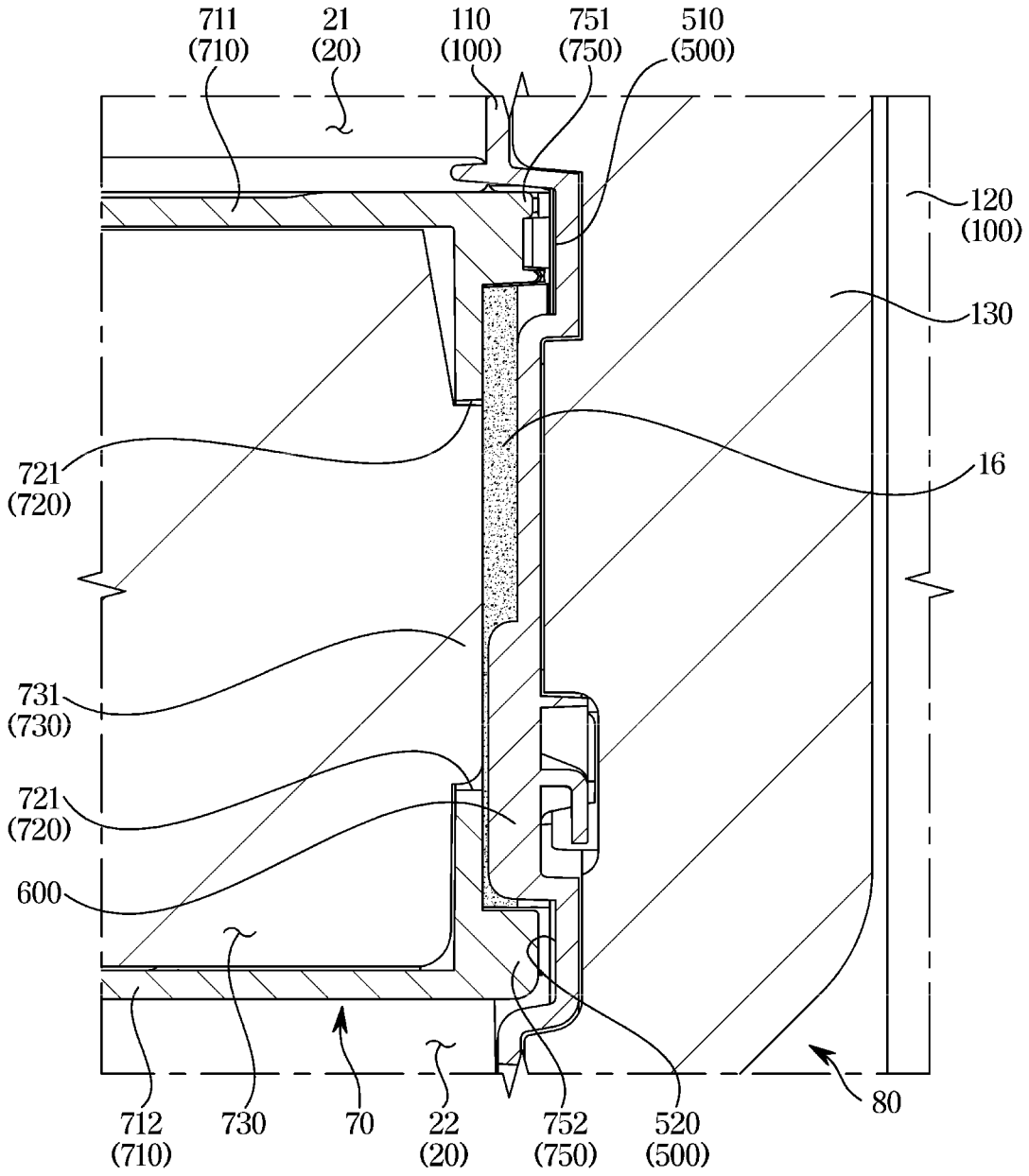
FIG. 16 is an enlarged view of part "A" shown in FIG. 2.

FIG. 16 is an enlarged view of part "A" shown in FIG. 2.

Referring to FIG. 16, the duct 80 and the partition 70 may be coupled together. A front portion of the duct 80 and a rear portion of the partition 70 may be coupled to each other. The first coupling portion 500 of the duct 80 and the second coupling portion 750 of the partition 70 may be coupled.

For example, the duct 80 and the partition 70 may be coupled in at least two portions. For example, the duct 80 and the partition 70 may be coupled at an upper portion and a lower portion. For example, the upper protrusion 751 and the upper groove 510 may be coupled at the upper portion, and the lower protrusion 752 and the lower groove 520 may be coupled at the lower portion. As a result, the duct 80 and the partition 70 may be more stably coupled.

For example, the upper protrusion 751 may be inserted into the upper groove 510. The lower protrusion 752 may be inserted into the lower groove 520. In the drawings, it is shown that the upper protrusion 751 and the lower protrusion 752 are formed in the partition 70, and the upper groove 510 and the lower groove 520 are formed in the duct 80, but are not limited thereto. In contrast to what is shown in the drawings, the upper protrusion and the lower protrusion may be formed in the duct 80, and the upper groove and the lower groove may be formed in the partition 70.

The protrusion 600 may be provided to press the partition 70 in a state in which the duct 80 and the partition 70 are coupled. The protrusion 600 may be provided to press the partition 70 between the portion in which the upper groove 510 and the upper protrusion 751 are coupled together (i.e., the first portion), and the portion in which the lower groove 520 and the lower protrusion 752 are coupled together (i.e., the second portion). The protrusion 600 may be provided to be in close contact with the partition body 710 and/or the partition insulator 730 exposed through the partition holes 720. In response to the protrusion 600 pressing against the partition 70, a repulsive force may be generated. As the duct 80 and the partition 70 are coupled, the duct 80 may be arranged to press against the partition 70, and the partition 70 may be arranged to press against the duct 80.

With the structure described above, the coupling force between the partition 70 and the duct 80 may be improved. Accordingly, cool air in the freezing compartment 22 or cool air in the refrigerating compartment 21 may not flow easily between the partition 70 and the duct 80. Heat conduction between the freezing compartment 22 and the refrigerating compartment 21 may be prevented as much as possible. The freezing compartment 22 and the refrigerating compartment 21 may be more reliably insulated. As a result, the cooling efficiency of the refrigerator 1 may not be reduced. Furthermore, the adhesion between the duct body 100 of the duct 80 and the duct insulator 130 may be improved. The gap between the duct body 100 and the duct insulator 130 may not be occur. Exterior deformation, such as forward bending of the duct body 100 may not occur.

In the drawings, the partition 70 and the duct 80 are shown to be in close contact with the first sealing member 16 interposed therebetween, but is only an example. The partition 70 and the duct 80 may be provided to be in close direct contact with each other.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator, comprising:

an inner case forming a storage compartment;

a duct in the storage compartment, the duct including:

a duct body including a protrusion protruding from a front surface of the duct body, and a first coupling portion on the front surface of the duct body, wherein the duct allows air to flow through the duct; and a partition detachably mountable in front of the duct so as to divide the storage compartment into a refrigerating compartment and a freezing compartment positioned below the refrigerating compartment, the partition including:

a partition body, a second coupling portion on a rear surface of the partition body and couplable to the first coupling portion, a partition hole in the rear surface of the partition body, and a partition insulator within the partition body and including an exposed portion that protrudes backward into the partition hole so as to be exposed to an outside of the partition body through the partition hole, wherein the partition and the duct are configured such that, with the partition mounted in front of the duct and the second coupling portion coupled to the first coupling portion, the exposed portion is in close contact with the duct body and the protrusion protrudes toward and presses against the partition.

2. The refrigerator of claim 1, wherein one of the first coupling portion and the second coupling portion includes a coupling protrusion, another one of the first coupling portion and the second coupling portion includes a coupling groove corresponding to the coupling protrusion, and with the partition mounted in front of the duct and the second coupling portion coupled to the first coupling portion, the coupling protrusion is detachably coupled to the coupling groove.

3. The refrigerator of claim 1, wherein the first coupling portion includes:

an upper groove, and a lower groove spaced downward from the upper groove, and the second coupling portion includes:

an upper protrusion, and a lower protrusion spaced downward from the upper protrusion, and with the partition mounted in front of the duct and the second coupling portion coupled to the first coupling portion, the upper protrusion is inserted into the upper groove and the lower protrusion is inserted into the lower groove.

4. The refrigerator of claim 1, wherein the first coupling portion includes:

an upper groove, and a lower groove spaced downward from the upper groove, the protrusion is between the upper groove and the lower groove, the second coupling portion includes:

an upper protrusion, and a lower protrusion spaced downward from the upper protrusion, and with the partition mounted in front of the duct and the second coupling portion coupled to the first coupling portion, the upper protrusion is inserted into the upper groove and the lower protrusion is inserted into the lower groove.

5. The refrigerator of claim 1, wherein the partition body includes:

a first partition body having a lower portion, a second partition body detachably coupled to the lower portion, and a parting line between the first partition body with the second partition body.

6. The refrigerator of claim 5, wherein the parting line is closer to the freezing compartment than the refrigerating compartment with the partition mounted in front of the duct and the second coupling portion coupled to the first coupling portion.

7. The refrigerator of claim 1, further comprising:

a duct insulator within the duct body, and in response to the protrusion pressing against the partition with the partition mounted in front of the duct and the second coupling portion coupled to the first coupling portion, the duct body and the duct insulator are brought into close contact with each other.

8. The refrigerator of claim 1, wherein the protrusion is disposed at a vertical center line of the duct body.

9. The refrigerator of claim 1, wherein the partition hole is a first partition hole, the exposed portion is a first exposed portion, and the partition further includes:

a second partition hole on a side surface of the partition body, and a second exposed portion exposed through the second partition hole and configured such that, with the partition mounted in front of the duct and the second coupling portion coupled to the first coupling portion, the second exposed portion is in close contact with the inner case.

10. The refrigerator of claim 9, wherein a second exposed portion is configured such that with the partition mounted in front of the duct and the second coupling portion coupled to the first coupling portion, the second exposed portion is in close contact with at least one side wall of the inner case.

11. The refrigerator of claim 1, further comprising:

an evaporator disposed within the storage compartment; and the duct further includes:

a first outlet communicating with the refrigerating compartment to allow air that has exchanged heat with the evaporator to be supplied to the refrigerating compartment, a first recovery port positioned below the first outlet and communicating with the refrigerating compartment to allow air in the refrigerating compartment to be recovered, a second outlet communicating with the freezing compartment to allow air that has exchanged heat with the evaporator to be supplied to the freezing compartment, and a second recovery port positioned below the second outlet and communicating with the freezing compartment to allow air in the freezing compartment to be recovered.

12. The refrigerator of claim 11, wherein the partition is between the first recovery port and the second outlet with the partition mounted in front of the duct and the second coupling portion coupled to the first coupling portion.

13. The refrigerator of claim 1, wherein the protrusion includes a plurality of protrusions spaced apart from each other.

14. The refrigerator of claim 1, further comprising:

a sealing member interposed between the duct and the partition with the partition mounted in front of the duct and the second coupling portion coupled to the first coupling portion.

15. The refrigerator of claim 1, further comprising:

a fastening body extending from the partition body; and a screw extending through the fastening body and into the duct to maintain a coupling force between the first coupling portion and the second coupling portion with the partition mounted in front of the duct and the second coupling portion coupled to the first coupling portion.

16. The refrigerator of claim 1, wherein the partition hole is among a plurality of partition holes in a rear surface of the partition body, the exposed portion is among a plurality of exposed portions respectively corresponding to the plurality of partition holes, and each exposed portion of the plurality of exposed portions protrudes backward into a respectively corresponding partition hole of the plurality of partition holes so as to be exposed to an outside of the partition body through the respectively corresponding partition hole.

17. The refrigerator of claim 1, wherein the partition insulator is further configured such that, with the partition mounted in front of the duct and the second coupling portion coupled to the first coupling portion, the exposed portion is exposed to the outside of the partition body toward the duct.

18. The refrigerator of claim 1, wherein the exposed portion is exposed to a rear side of the partition body.

19. The refrigerator of claim 1, wherein the exposed portion is connected to the rear surface of the partition body.

* * * * *